US007183994B2

(12) United States Patent
Weigand

(10) Patent No.: US 7,183,994 B2
(45) Date of Patent: Feb. 27, 2007

(54) COMPACT ANTENNA WITH DIRECTED RADIATION PATTERN

(75) Inventor: Steven Weigand, Santa Clara, CA (US)

(73) Assignee: WJ Communications, Inc., San Jose, CA (US)

( * ) Notice: Subject to any disclaimer, the term of this patent is extended or adjusted under 35 U.S.C. 154(b) by 24 days.

(21) Appl. No.: 11/173,574

(22) Filed: Jul. 1, 2005

(65) Prior Publication Data

US 2006/0109192 A1 May 25, 2006

Related U.S. Application Data

(60) Provisional application No. 60/630,509, filed on Nov. 22, 2004.

(51) Int. Cl.
*H01Q 9/28* (2006.01)

(52) U.S. Cl. ..... 343/795; 343/702; 343/700 MS

(58) Field of Classification Search ..... 343/700 MS, 343/795, 793, 796, 806, 803, 820, 821, 822, 343/702

See application file for complete search history.

(56) References Cited

U.S. PATENT DOCUMENTS

| | | | | |
|---|---|---|---|---|
| 5,495,260 | A | 2/1996 | Couture | |
| 7,023,909 | B1 * | 4/2006 | Adams et al. | 375/222 |
| 2006/0125697 | A1 * | 6/2006 | Hung et al. | 343/700 MS |
| 2006/0158378 | A1 * | 7/2006 | Pons et al. | 343/700 MS |

OTHER PUBLICATIONS

Kadambi, Govind R., et al., "Miniaturized Dual ISM Band Internal Antennas", Centurion Wireless Technologies, Inc., pp. 1-4, no date available.

Lin, C.-C., et al., "A 2.4 GHZ Printed Meander-Line Antenna for WLAN Applications", Department of Electrical Engineering, IEEE No. 0-7803-8302-8, (Aug. 2004) pp. 1-4.

Marrocco, Gaetano, "Gain-Optimized Self-Resonant Meander Line Antennas for RFID Applications", IEEE Antennas And Wireless Propagation Letters, vol. 2, No. 1536-1225 (2003) pp. 302-305.

Schulteis, S., et al., "A Small Planar Inverted F Antenna with Capacitive and Inductive Loading", IEEE No. 0-7803-8302-8, (2004) pp. 1-4.

Schwindt, Randal, et al., "Computer-Aided Analysis and Design of a Planar Multilayer Marchang Balun", IEEE Transactions on Microwave Theory and Techniques, vol. 42, No. 7, (Jul. 1994) pp. 1429-1434.

Soras, C., et al., "Analysis and Design of an Inverted-F Antenna Printed on a PCMCIA Card for the 2.4 GHz ISM Band", IEEE Antenna's and Propagation Magazine, vol. 44, No. 1, (Feb. 2002) pp. 37-44.

(Unknown) "915 MHz ISM Band Remote Temperature Monitoring Demo—User Guide Version 1.0 Preliminary", Integration Wireless Documentation, Integration Associates, Inc., vol. IA ISM-UGTD, Rev. 1.0 0104 (2004).

* cited by examiner

*Primary Examiner*—Hoanganh Le
(74) *Attorney, Agent, or Firm*—Morgan Lewis & Bockius LLP

(57) ABSTRACT

The present invention includes a balanced compact antenna, conforming to the envelope restrictions appropriate to a PC-card form factor, with maximum radiation intensity along a long axis of the card. The inventive antenna configuration employs an inductive shorting bar to match an "M"-shaped bent dipole antenna to a differential feed. The combination of horizontal cross-members and large vertical downward legs ensures radiation predominantly in a broadside direction while keeping the dimensions of the antenna sufficiently compact to fit within the PC-card envelope.

20 Claims, 31 Drawing Sheets

COMPACT ANTENNA WITH DIRECTED RADIATION PATTERN

CROSS REFERENCE TO RELATED APPLICATIONS

The present application claims the benefit of and priority to U.S. Provisional Patent Application Ser. No. 60/630,509, filed on Nov. 22, 2004, the entire disclosure of which is incorporated herein by reference.

FIELD OF THE INVENTION

The present invention is related to communications using radio frequency signals, and more particularly to an improved compact antenna having a forward-directed radiation pattern.

BACKGROUND

Radio Frequency Identification (RFID) technologies are widely used for automatic identification. A basic RFID system includes an RFID tag or transponder carrying identification data and an RFID interrogator or reader that reads and/or writes the identification data. An RFID tag typically includes a microchip for data storage and processing, and a coupling element, such as an antenna, for communication. An RFID reader operates by writing data into the tags or interrogating tags for their data through a radio-frequency (RF) interface. During interrogation, the reader forms and transmits RF waves, which are used by tags to generate response data according to information stored therein. The reader also detects reflected or backscattered signals from the tags at the same frequency, or, in the case of a chirped interrogation waveform, at a slightly different frequency.

RF readers can operate at a number of different frequency bands or ranges. Common low frequency ranges include 125–134 KHz and 13.56 MHz, and common high frequency or ultra-high frequency (UHF) ranges include 860–960 MHz, and 2.4–2.5 GHz. RFID systems operating at the low-frequency ranges are widely used and are inexpensive, but have the fundamental disadvantage that coupling between the reader antenna and the tag antenna is almost entirely inductive. As a consequence, the power that can be coupled to the tag falls rapidly when the distance between the reader and the tag is greater than roughly the antenna size. Since the reader antenna size is typically limited to around 1 meter, an interrogation range characterized by a maximum operable reader-tag separation in low-frequency systems is similarly limited to less than about 1 meter, with typical interrogation range for high data rate applications being even shorter (e.g., a few tens of cm). This interrogation range, although limited, still allows many useful applications, but when longer interrogation range is required, it is appropriate to consider UHF (i.e., 900 MHz or higher) systems, which allows much longer interrogation ranges, such as from about 3 to 8 meters, to be achieved.

Conventional RFID readers operating at the UHF frequency band around 900 MHz have been large, separately packaged devices attached to removable external antennas or integrated with an antenna. Examples of these readers include the ALR9780 and ALR 9040 readers from Alien Technology, the AR400 and SR400 devices from Matrics/Symbol, and the ITRF and IF5 readers from Intermec Inc. Relatively large handheld readers with integral antennas have also been reported, such as the IP3 and Sabre 1555 devices from Intermec Inc.

RFID readers have not been made in a PC Card format so that it can be integrated in handheld, portable or laptop computers to read from and write to RFID tags. It is apparent that incorporation of a RFID reader into a PCMCIA-compatible ("PC-card") form factor will provide numerous practical advantages, since a user may then employ the PC-card-reader in any PC-card-compatible device, such as a laptop computer, or personal digital assistant (PDA), with only the addition of appropriate software. In this fashion virtually any portable computing device can be RFID-enabled. The flexibility of an RFID reader on a PC Card also allows easy integration of an intelligent long-range (ILR) system into enterprise systems and permits combination with other technologies such as bar code and wireless local area networks (LAN). The making of a PC Card RFID reader, however, presents many challenges, one of them is associated with the design of a suitable antenna.

SUMMARY OF THE INVENTION

The present invention includes a balanced compact antenna, which can be made to conform to envelope restrictions of a PC-card form factor, with maximum radiation intensity along a central axis of the antenna. The inventive antenna configuration employs an inductive shorting bar to match an "M"-shaped dipole antenna to a differential feed. The combination of horizontal cross-members and large vertical downward legs ensures radiation predominantly in directions along the central axis of the antenna, while keeping the dimensions of the antenna sufficiently compact to fit within a PC-card envelope. The antenna can be built on a substrate and comprises a pair of conductor lines formed on the substrate and an inductive shunt connected between the pair of conductor lines. The pair of conductor lines have a pair of feed portions extending from a pair input terminals, respectively, toward left and right edges of the substrate, a pair of riser portions extending a distance L from respective ends of the pair of feed portions toward a top edge of the substrate, a pair of radiating cross-members extending a distance L1 from respective ends of the pair of riser portions toward left and right edges of the substrate, and a pair of downward leg portions extending a distance L2 from respective ends of the pair of radiating cross members toward a lower edge of the substrate. The inductive shunt is parallel with the feed portions and extends between the pair of riser portions. In one embodiment of the present invention, the pair of conductor lines and the inductive shunt are arranged on the substrate such that the pair of conductor lines are positioned as mirror images of each other with respect to the central axis of the antenna, that the two input terminals are separated by a distance g, that the riser portions are each separated from the central axis by a distance H, that the inductive shunt is separated from the feed portions by a distance d, and that $H+L+L1+L2-d-w\approx\lambda/4$, where w is an approximate linewidth of the riser portions and $\lambda$ is the wavelength corresponding to a center frequency of a frequency band in which antenna 100 is designed to operate.

DETAILED DESCRIPTION OF THE INVENTION

Figure 1:
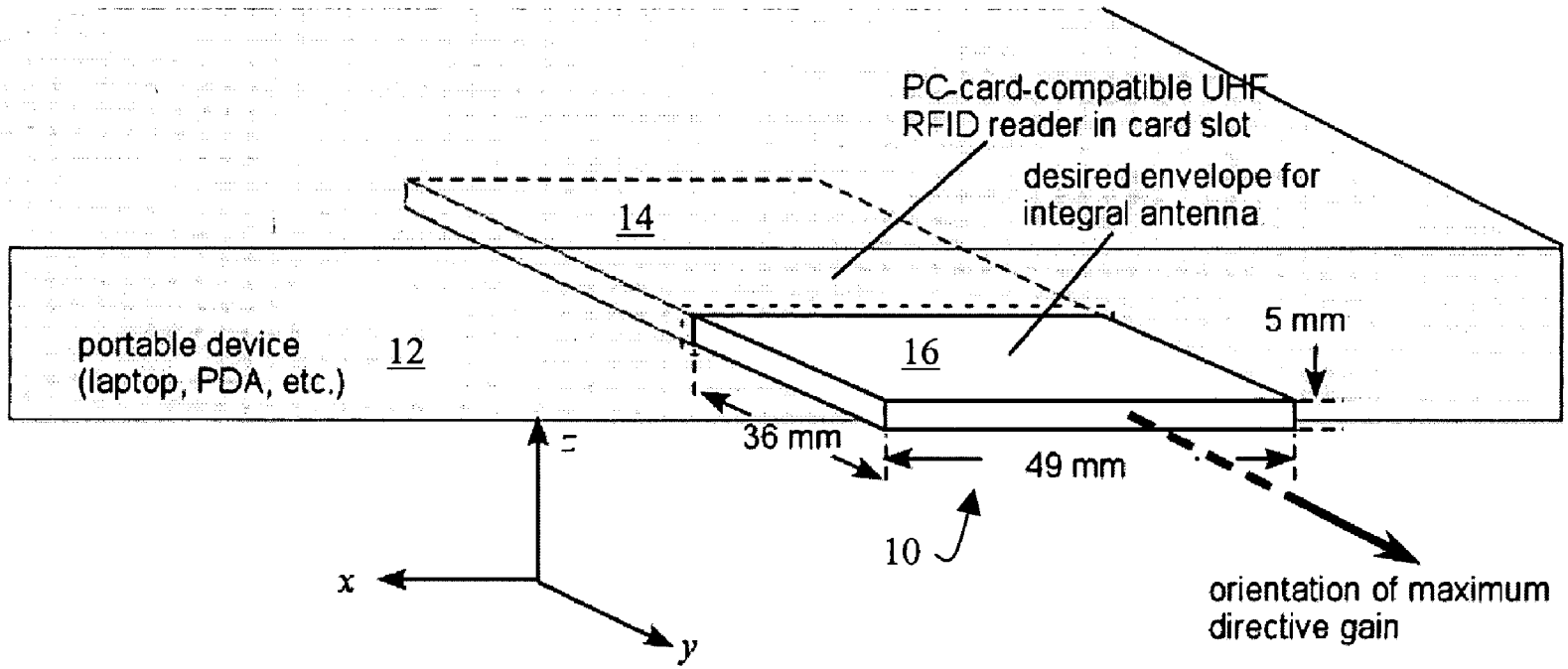
FIG. 1 is a schematic depiction of the envelop restrictions of a PC card form factor.

FIG. 1 illustrates a PC card RFID reader 10 inserted in a PC card slot of a computer system 12, which can be a portable computer system such as a laptop computer, a PDA device, or the like. As shown in FIG. 1, reader 10 has an inside portion 14 that is enclosed by the computer system 12 and an outside portion 16 that is protruding from the computer system 12. Reader 10 could employ removable antennas connected by, for example, a coaxial cable, or one or more integral antennas attached directly onto the protruded portion 16 of reader 10. The latter arrangement provides significant advantages in size, convenience, and portability for the end user of the reader, but creates significant challenges for antenna design. For maximum convenience and simplicity of use, the integral antenna should be no larger than a width w of the card slot, and at most only slightly thicker than a thickness d of the card. From the point of view of manufacturing cost, an antenna that can be printed on conventional circuit board material, possibly even the same circuit board used for building the reader circuitry, should be greatly preferred over an antenna requiring any out-of-plane assembly. In many cases the integral antenna will be mechanically vulnerable during use, and therefore should not protrude excessively beyond the protruded portion 16 of the card.

In many handheld or portable applications of reader 10, the near-field environment of the antenna is not well controlled. Thus, it is also very desirable that the antenna impedance be relatively insensitive to nearby metal or dielectric obstacles, so that good matching and power transfer to and from the reader will be maintained in the presence of people and common metallic objects. Finally, it is very desirable that the integral antenna should direct the majority of its radiation in a 'forward' direction pointing away from the computer system 12 (i.e., along the y axis in FIG. 1), so that a user may rely upon the orientation of the computer system 110 as a somewhat-reliable indicator of the location of the responding RFID tags, at least in short read ranges. In real indoor environments, due to reflection and diffraction from numerous complex obstacles generally present, precise localization by pointing the computer system at the tag cannot realistically be attained when the distance between the reader and the tag is larger than a meter or two.

In summary, an integral compact antenna for reader 10 preferably meets the following design goals:

- The antenna should have insignificant geometric height, and preferably be printed on the same board material upon which the reader is built.
- The antenna should mainly radiate in the forward direction when the reader is inserted in a computer system.
- The useable frequency range should cover a frequency band for unlicensed operation in the United States under FCC regulations, such as 902 MHz–928 MHz ($\lambda$~328 mm). Slightly different frequency bands may be needed for operation in other regulatory jurisdictions.
- The antenna should attach to a PCMCIA card housing, and more preferably in the protruded portion of the card when the card is inserted in a computer system. As a non-limiting example, the protruded portion may have the following dimensions: $L_x$=49 mm(0.15*$\lambda$), $L_y$=36 mm(0.11*$\lambda$), $L_z$=5 mm, as shown in FIG. 1.

Conventional antennas do not satisfy the above conditions. Among them, microstrip or 'patch' antennas are well-known, low-cost, versatile antennas. However, the main direction of radiation for a patch antenna is perpendicular to the plane of the patch. Patch antennas are also generally close to half of a wavelength in length in order to provide a near-resonant real load. At radio frequency, this length would significantly exceed that achievable using conventional printed-circuit board materials and configurations. A patch antenna is thus unsuitable for a PC card reader.

Figure 2:
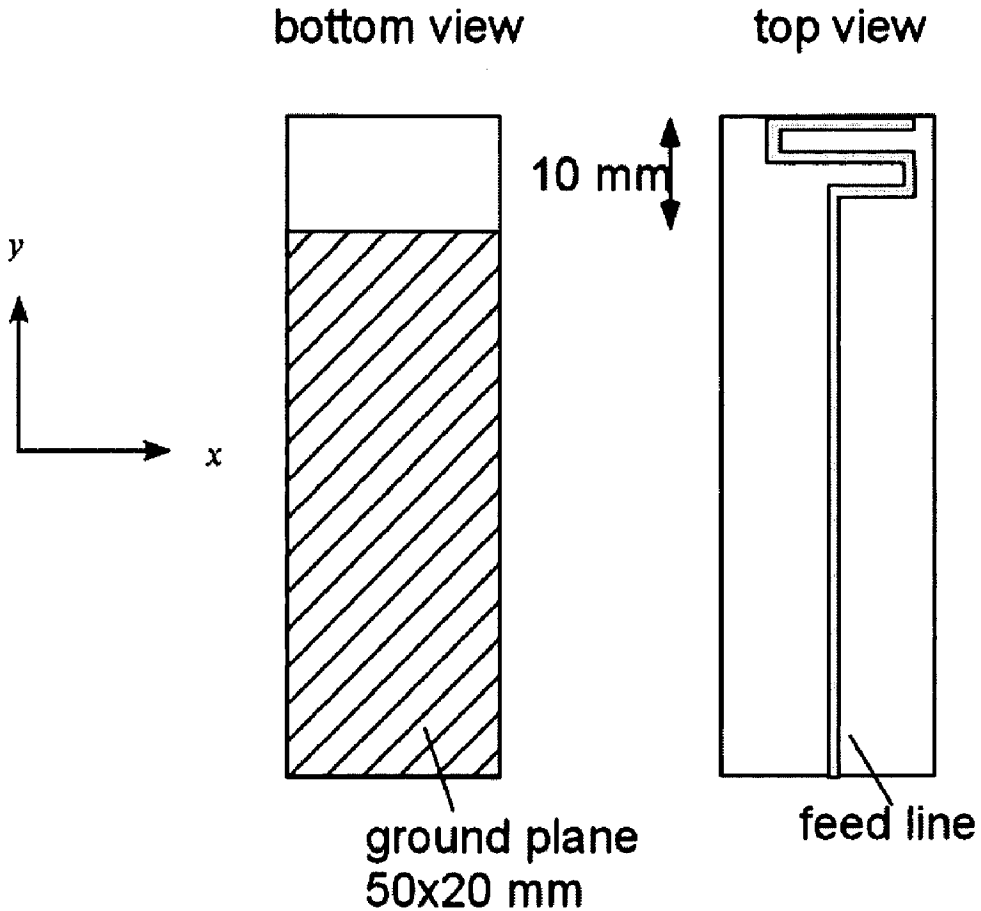
FIG. 2 is a diagram of a prior art meandered printed wire 2.4 GHz antenna.

A meandered 2.4 GHz antenna disclosed by Lin, et al. and shown in FIG. 2 may be configured to fit within an appropriate size envelope for a PC card reader. This antenna can also be scaled for acceptable impedance matching at 900 MHz, but the effects of currents flowing parallel to the x axis in successive horizontal arms of the meander line nearly cancel in far field. So, this antenna radiates ineffectively in the y-direction, and is thus unsuitable for a PC card reader.

Figure 3:
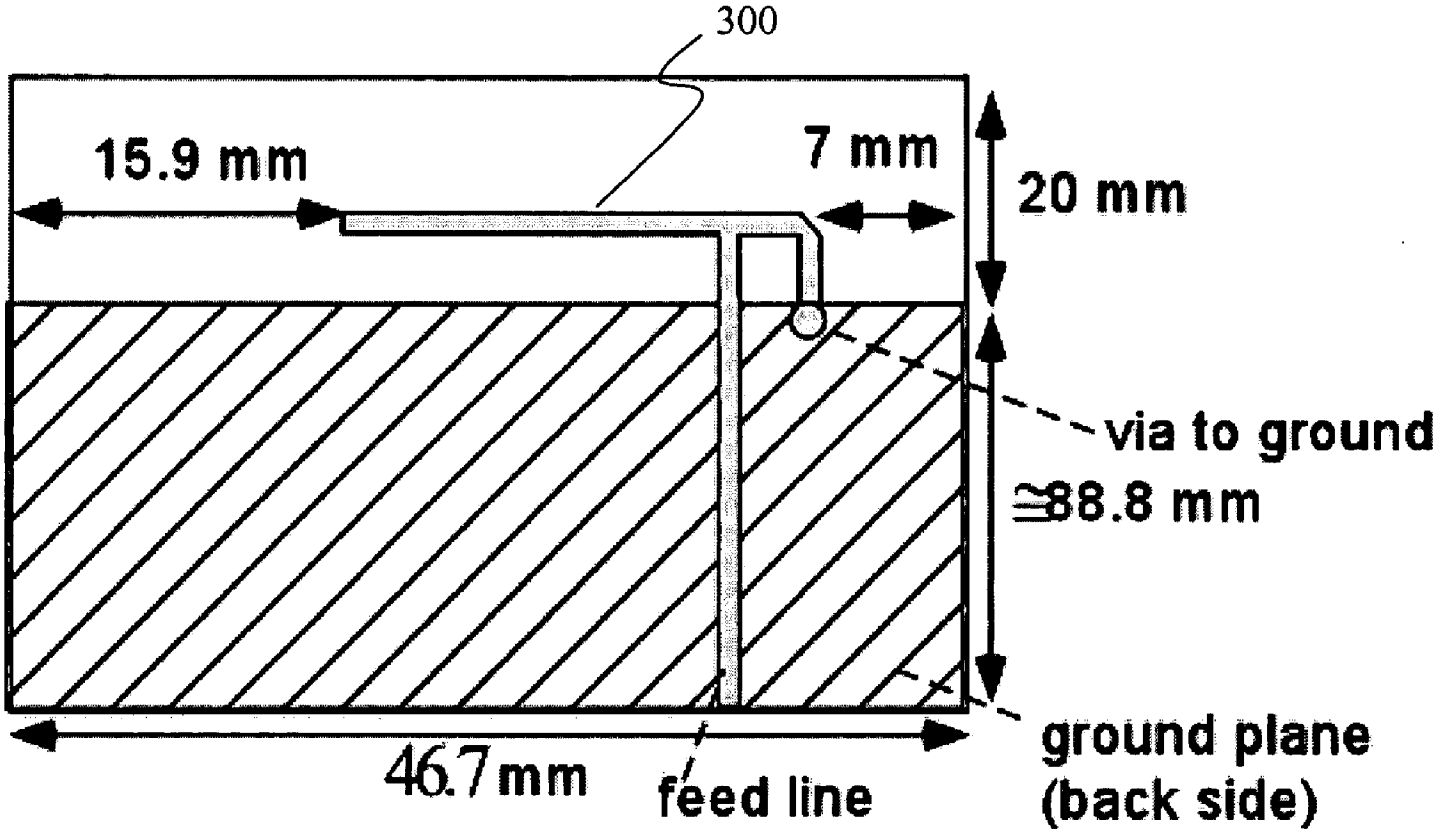
FIG. 3 is a diagram of a prior art inverted-F antenna for 2.4 GHz PC-card compatible transmission with broadside radiation.

In order to obtain significant radiation in the y-direction, one can start with a quarter-wave 'monopole' antenna over a ground plane, and then bend the main part of the dipole so that it is directed over the ground plane. A shunt inductor connected near the antenna feed can be used to compensate for the capacitive loading from the proximity of the ground plane. A well-known configuration of this type is the 'inverted-F' antenna described by, for example, Soras, Karaboikis, Tsachtsiris and Makios, which has a 2.4 GHz PC-card-compatible configuration, shown schematically in FIG. 3. Unfortunately, this antenna, if scaled for 900 MHz operations, would be too large for the PC-card form factor. Furthermore, this antenna has an 'unbalanced' design, in which a single-ended current flows in a radiating wire 300 connected to a feed line with reference to a large ground plane. As such, the antenna impedance is sensitive to the size and shape of the ground plane and therefore the configuration of the radio circuitry in the card and the card-mounting environment, as well as nearby dielectric or metallic objects.

Figure 4:
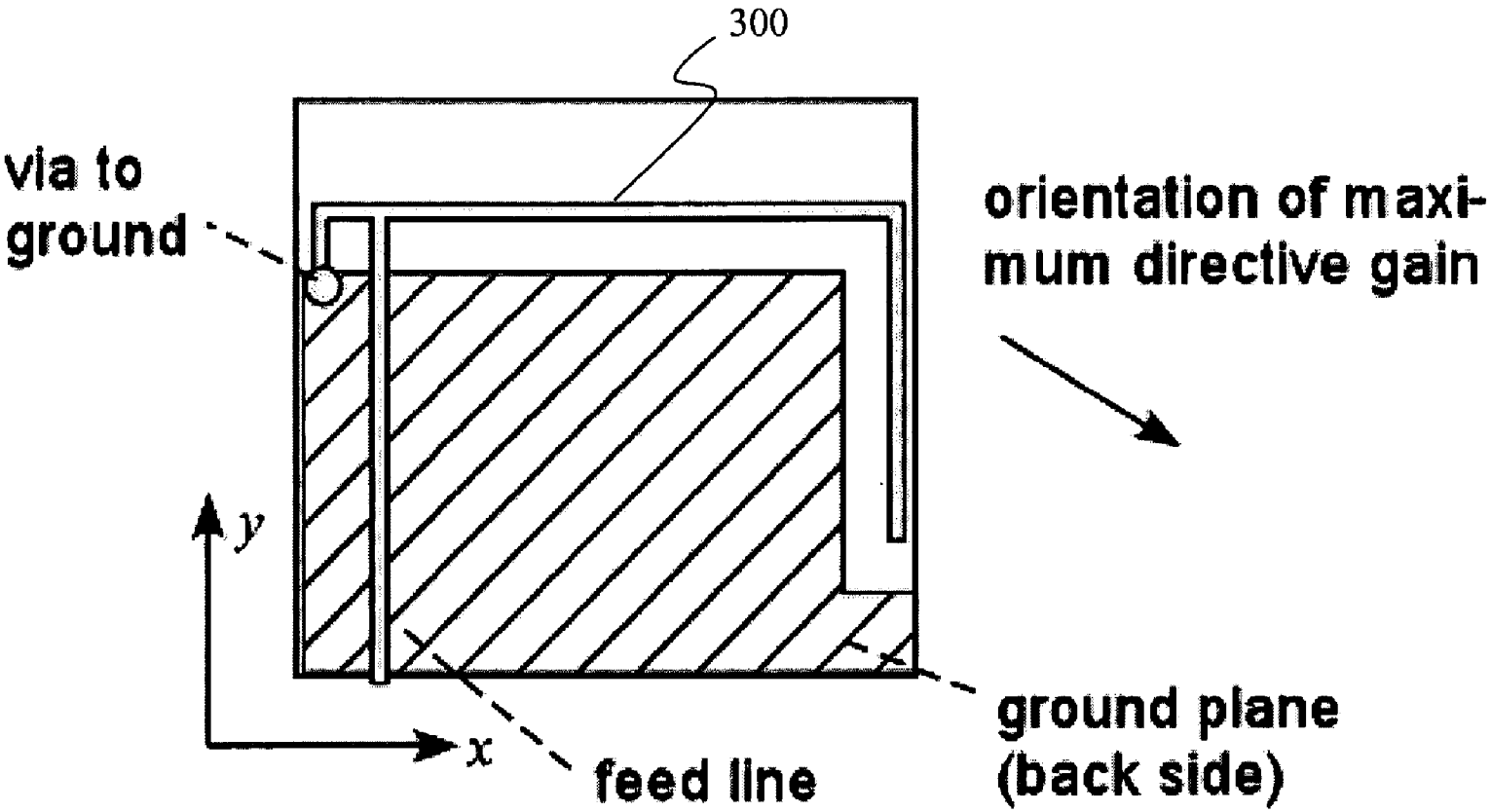
FIG. 4 is a diagram of a prior art variant of the inverted-F antenna with reduced lateral extent

Certain variations of the inverted-F antenna have been examined using simulation in an attempt to arrive at a 900-MHz version that could be contained within the required physical envelope. For example, FIG. 4 shows a possible variant in which the radiating wire 300 is bent a second time to contain it within the allowed lateral spacing. However, because of the significant uncompensated vertical current from the final leg of the wire, this antenna directs most of its power towards the lower right, as shown in the figure.

Figure 5:
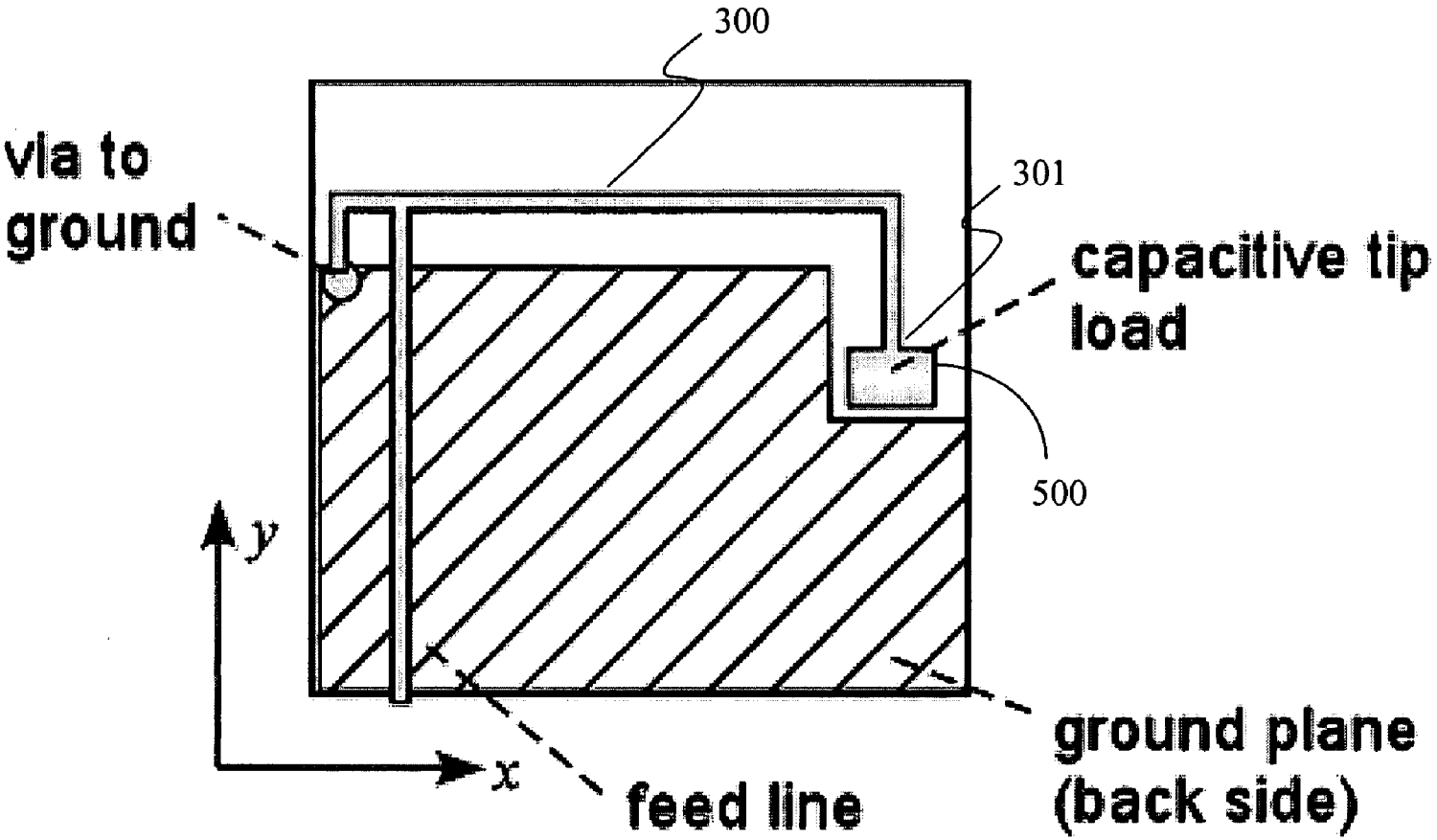
FIG. 5 is a diagram of another prior art variant of the inverted F with lumped capacitor termination to reduce wire length.

As shown in FIG. 5, the length of the radiating wire 300 can also be reduced by placing a lumped inductor (not shown) at a feed point, or a lumped capacitor plate 500 at an end 301. In this fashion the width of the antenna can be reduced to about 41 mm ($\lambda/8$). However, at this size the antenna is only 8 mm narrower than the PC-card-constrained ground plane, and thus the image of the antenna in the ground plane is about the same size as the antenna; therefore there is little radiation in the desired y-direction (that is, the ground plane image is too small). Attempts to reduce the width of the antenna to less than an eighth of a wavelength result in significant reduction in the radiation resistance of the antenna, making it very difficult to achieve a good electrical match.

Figure 6:
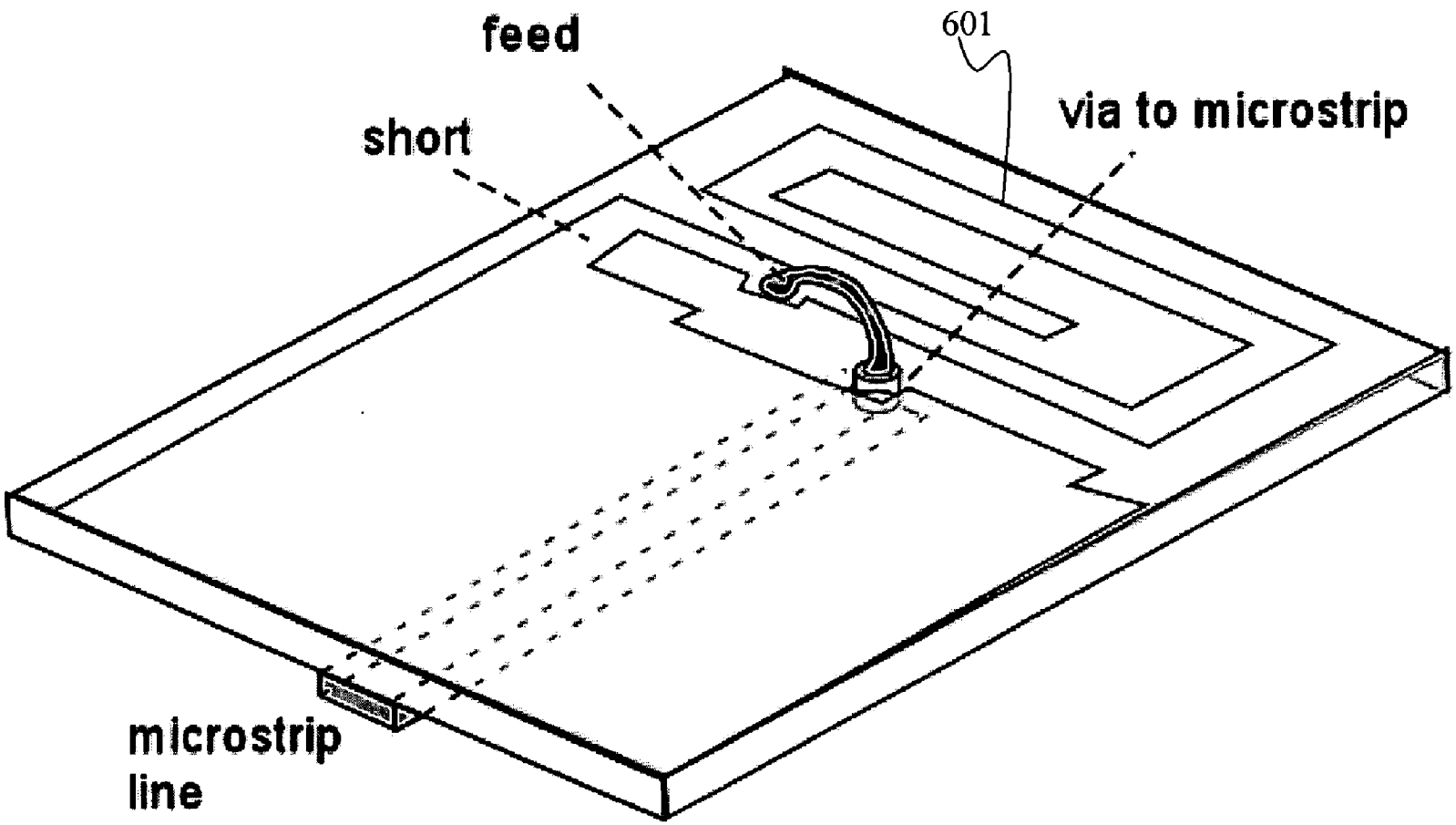
FIG. 6 is a diagram of a prior art multiple-folded inverted-F antenna.

In order to reduce the lateral extent of the inverted-F antenna at 900 MHz, additional bends may be added. For example, Kadambi, Yarasi, Sullivan and Hebron have disclosed a multiple-bend inverted-F having successive legs 601, as shown in FIG. 6. However, like the antenna of Lin et al. in FIG. 2, the currents flowing in the successive legs 601 nearly cancel each other in the far field.

Figure 7:
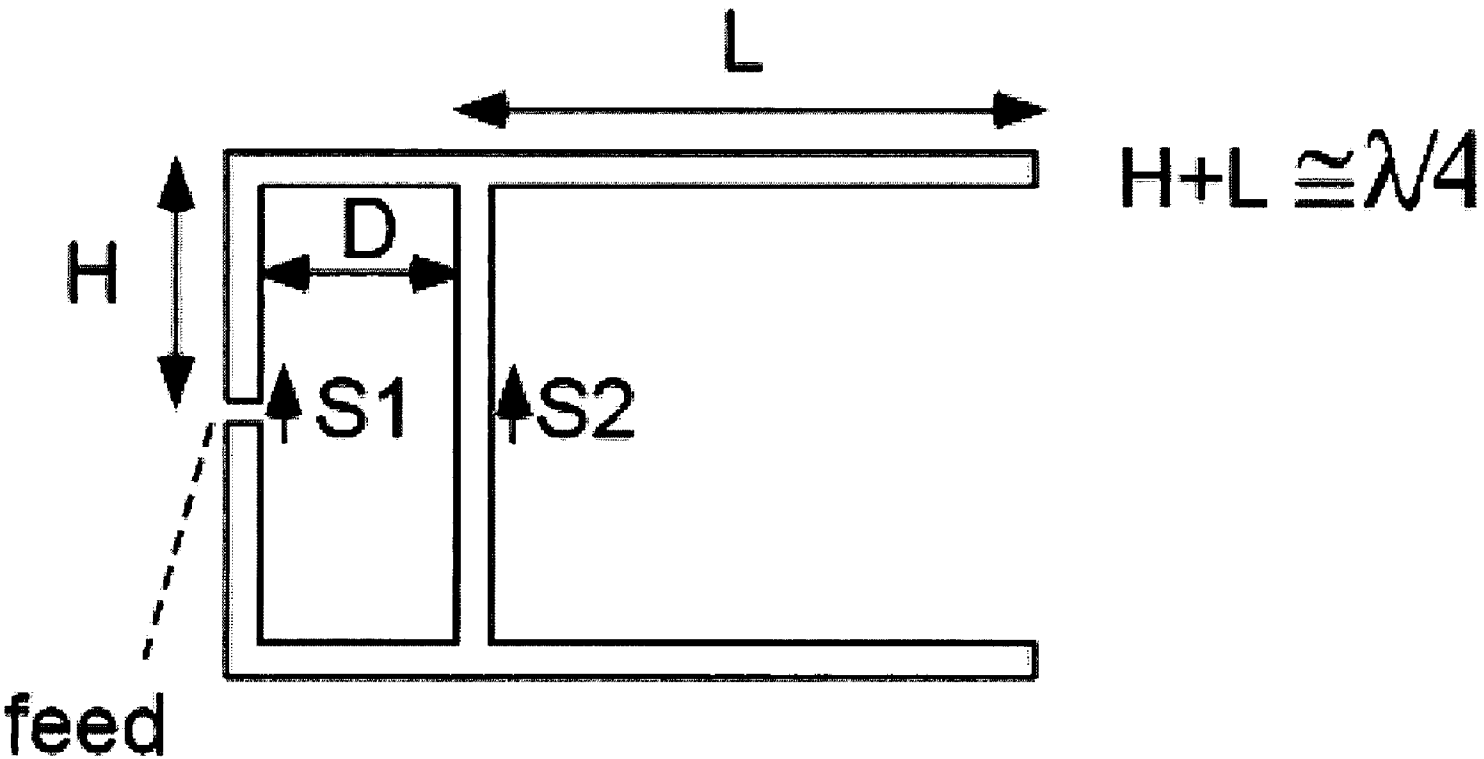
FIG. 7 is a diagram of a prior art balanced inverted-F antenna.

Furthermore, none of these inverted-F variants address the problem of unbalanced operation and consequent sensitivity of the match to ambient objects. Compact balanced implementations are even more challenging than unbalanced antennas. As balanced arms are required, more space is used. An example of balanced implementation of an inverted-F configuration has been provided by Schulteis, Waldschmidt, Sorgel and Wiesbeck and depicted in FIG. 7, which is much larger than allowed for PC card application at about 900 MHz. According to the authors, the antenna size can be reduced by up to 20% using lumped tuning elements. But that is still not sufficient to fit within a PC-card envelope.

Figure 8:
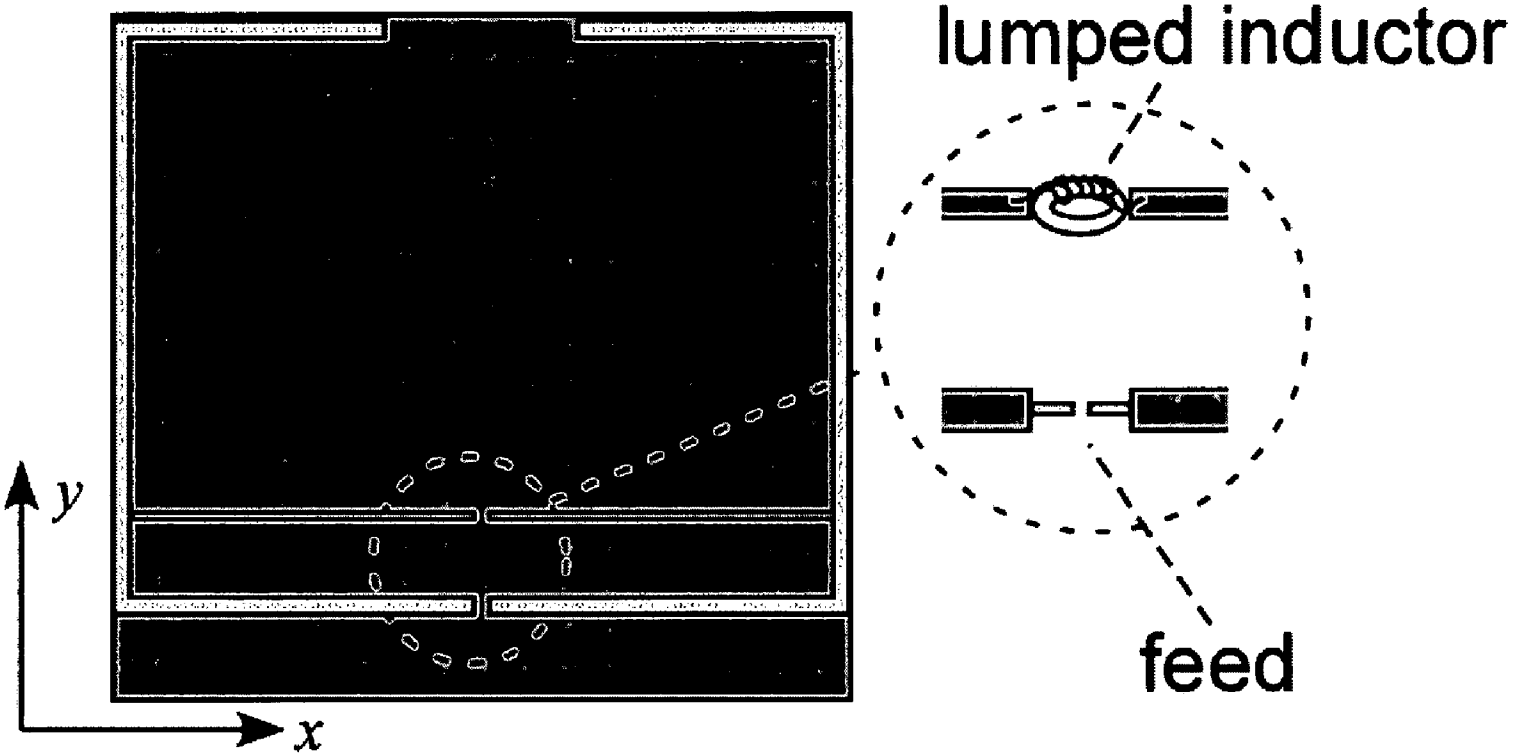
FIG. 8 is a diagram of a prior art variant of the balanced inverted-F antenna using lumped inductors.

Variations of the balanced inverted-F antenna have also been examined by simulation. In one variation, the electric antenna length is increased, a lumped inductor is added to the center of wire S2 in FIG. 7, the center of wire S1 is fed with a discrete port, and the antenna is further bent at the top, resulting in a configuration shown in FIG. 8. The final bends at the top is to achieve a further size reduction in order to fit the whole antenna within the desired size envelope, but they also cause horizontal currents (parallel to the x axis) to flow, partially canceling the effects of currents on the lower branch of the antenna and reducing desired radiation in the y-direction.

Figure 9:
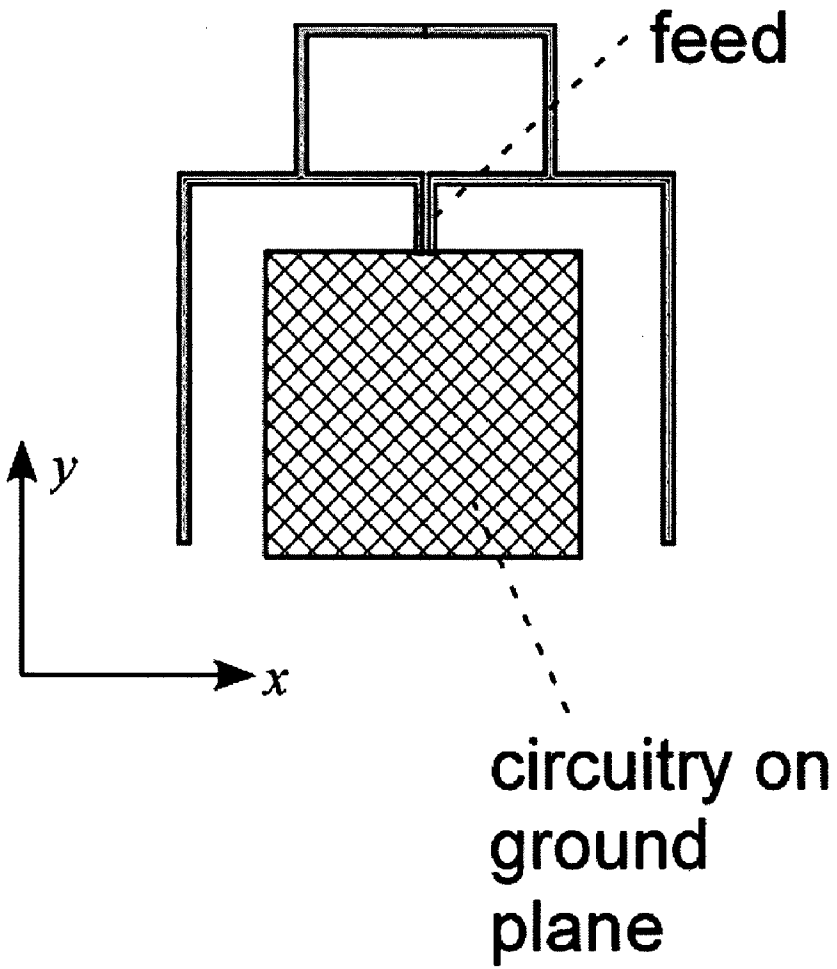
FIG. 9 is a diagram of a bent differential inverted-F antenna.

Another variation of the balanced inverted-F design, in which the antenna bend is placed past the location at which the inductive shunt is tapped, has been described in documents by Integration Associates, Inc., and is shown in FIG. 9. This configuration has better forward radiation properties since there is no cancellation of horizontal currents. Unfortunately, since the straight portion of the feed line extends past the tap, the width of the antenna becomes excessively large for the PC-card form factor.

Therefore, none of the prior art clearly discloses an antenna that can meet the demanding requirements set forth above for a compact, integral antenna attached to an RFID reader compatible with a PC-card form factor.

Figure 10:
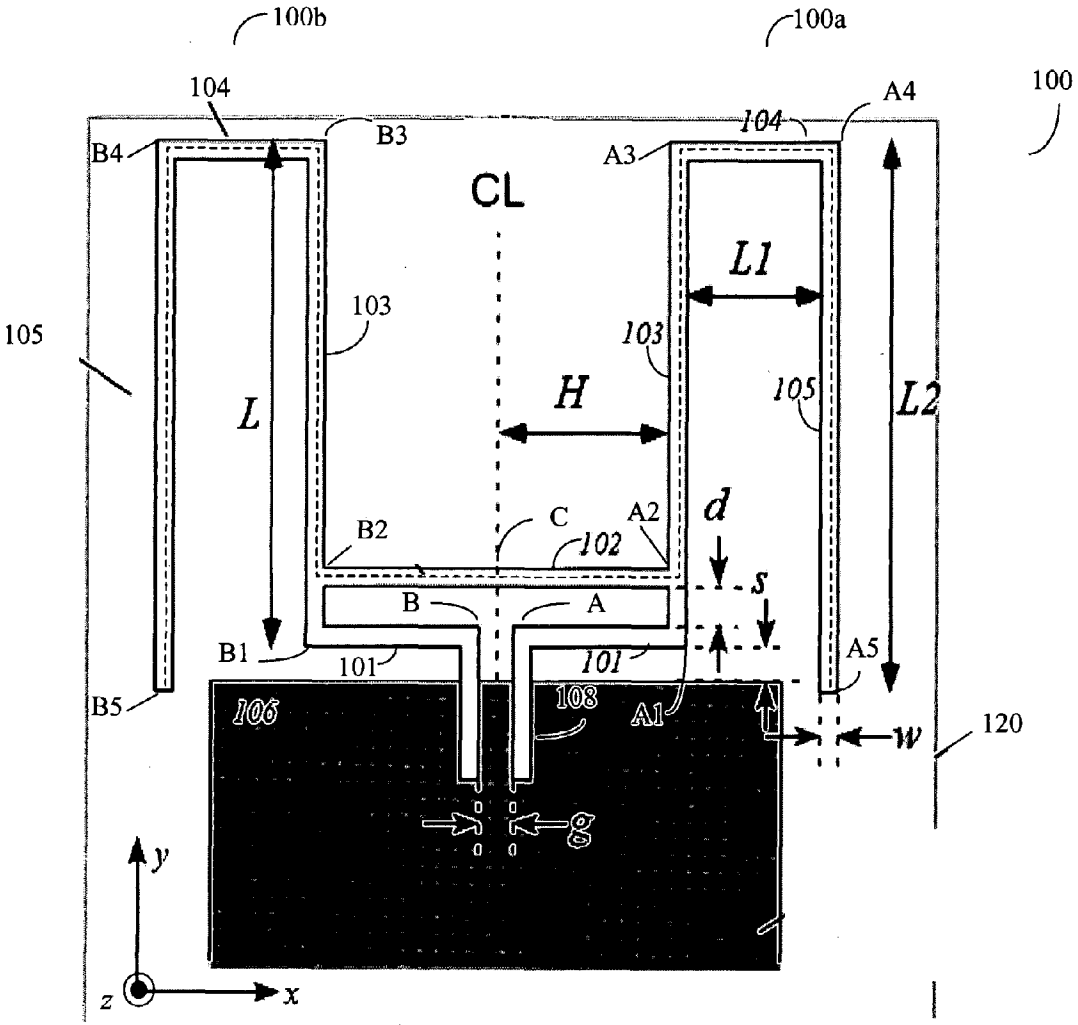
FIG. 10 is a top view of a compact antenna with directed radiation pattern according to one embodiment of the present invention

FIG. 10 illustrates a compact forward-directed antenna 100 according to one embodiment of the present invention. As shown in FIG. 10, antenna 100 comprises a pair of conductor lines 100*a* and 100*b*. Conductor line 100*a* has a feed portion 101 extending from an input terminal A along a first direction, a riser portion 103 extending a length L from an end A1 along a second direction to an end A3, a radiating cross-member 104 extending a length L1 along a third direction, and a downward leg portion 105 extending a length L2 from an end A4 along a fourth direction to an end A5. Likewise, conductor line 100*b* has a feed portion 101 extending from an input terminal B along a fifth direction, a riser portion 103 extending a length L from an end B1 along a sixth direction to an end B3, a radiating cross-member 104 extending a length L1 along a seventh direction, and a downward leg portion 105 extending a length L2 from an end B4 along an eighth direction to an end B5.

The second direction is substantially perpendicular to the first direction, the third direction is substantially parallel to the first direction, and the fourth direction is substantially opposite to the second direction. Likewise, the sixth direction is substantially perpendicular to the fifth direction, the seventh direction is substantially parallel to the fifth direction, and the eighth direction is substantially opposite to the sixth direction. Also, the fifth direction is substantially opposite to the first direction and the seventh direction is substantially opposite to the third direction. In one embodiment of the present invention, as shown in FIG. 10, the first and third directions are along the x-direction, the second and sixth directions are along the y-direction, the fifth and seventh directions are along the negative x-direction, and the fourth and eighth directions are along the negative y-direction.

Antenna 100 further includes a third conductor line 102 extending a length H from a center C of conductor line 102 toward inner edges of riser portions 103 of conductor lines 100*a* and 100*b*, and connecting with riser portion 103 of conductor lines 100*a* at point A2 and with riser portion 103 of conductor line 100*b* at point B2. In one embodiment of the present invention, the pair of conductor lines 100*a* and 100*b* and the third conductor line 102 are arranged in a plane (e.g., the x-y plane) such that the pair of conductor lines 100*a* and 100*b* are positioned as mirror images of each other with respect to a center line (CL) axis parallel to the y-direction, that terminals A and B are separated by a distance g, that the riser portions 103 of conductor lines 100*a* and 100*b* are each parallel to and separated from the CL axis by a distance H, that the third conductor line 102 is substantially parallel to feed portions 101 and distanced from the feed portions 101 by a distance d, and that $$l=H+L+L1+L2-d-w\approx\lambda/4 \quad (1)$$

where w is an approximate linewidth of the riser portion 103 of conductor lines 100*a* and 100*b*, λ is the wavelength corresponding to a center frequency, such as 915 MHz, of a frequency band in which antenna 100 is designed to operate, and l is a resonant length measured from the center C of conductor line 102 to either end A5 of conductor line 100*a* or end B5 of conductor line 100*b* along a center line (shown as dashed lines in FIG. 10) in either conductor line 100*a*, or conductor line 100*b*, respectively.

Still referring to FIG. 10, in one embodiment of the present invention, conductor lines, 100*a*, 100*b*, and 102 are etched metal traces printed on a first side of a substrate 120, such as an FR4 fiberglass composite substrate. A continuous metal ground plane 106 is formed on a second side opposite to the first side of substrate 120 to cover a portion of substrate 120 from the second side. An upper edge of the ground plane 106 is separated from the feed portions 101 by a distance s. Two parallel printed traces 108, which form a pair of coplanar transmission lines separated by gap g, may be provided to on the first side of substrate 120 connect the antenna to a radio front end that employs differential input/output connections. For a radio that generates a single-ended voltage signal referenced to the ground plane 106, conventional means can be employed to convert between the single-ended voltage output (not shown) from the radio and the balanced inputs to terminals A and B of antenna 100.

Another continuous metal ground plane 106 may also be formed on the first side of the substrate 120 to cover the same portion of the substrate 120 from the first side. Conventional means of isolation can be used to isolate the metal ground plane 106 on the first side from the co-planer transmission lines 108 or the single ended-voltage output.

Conductor line 102 acts as a shunt inductor to a virtual ground potential present along the CL axis. The shunt inductor separates each of conductor lines 100*a* and 100*b* into two parts, a first part running from terminal A to point A2 in riser 103 of conductor line 100*a* and from terminal B to point B2 in riser 103 of conductor line 100*b*, and a second part running from point A2 to end A5 in conductor line 100*a* and from point B2 to end B5 in conductor line 100*b*. The shunt inductance associated with the shunt inductor 102 resonates with the impedance of the second parts of conductor lines 100*a* and 100*b*, which impedance is capacitive because the second part of conductor line 100*a* or 100*b* has a length shorter than λ/4 according to Equation (1). Therefore a large amount of current should flow in the inductive shunt, that is, conductor line 102. Since most of the current in antenna 100 flows through the inductive shunt 102, the resonant length is approximately measured from the center of the shunt 102 rather than the center of the feed 101. Thus, the resonant length l equals approximately to H+L+L1+L2−d−w, which is set to be about a quarter of the wavelength corresponding to the center frequency, as expressed in Equation (1).

The above features of antenna 100 ensure that maximum current density occurs near a midpoint in conductor line 102 and is oriented along the x-axis in order to radiate in the y-z plane that is perpendicular to the x-axis. The horizontal radiating cross-members 104 of conductor lines 100*a* and 100*b* also provide currents along the x-axis with resulting radiation maximizing in directions perpendicular to the x-axis. The currents in the radiating cross-members 104 of conductor lines 100*a* and 100*b* are approximately in-phase with that in the inductive shunt 102 and thus adds instead of cancels the current in conductor line 102. The downward leg portions 105 of conductor lines 100*a* and 100*b* provide currents that approximately cancel the effects of currents flowing in the riser portions 103 of conductor lines 100*a* and 100*b*, respectively. Thus, undesired radiation in directions perpendicular to the y direction is minimized.

In one embodiment of the present invention, ends A5 and B5 at which the downward legs 105 terminate are arranged to be close to the ground plane 106, as shown in FIG. 10. This arrangement allows for a convenient addition of tip-loading overlap capacitance by slightly extending conductor lines 100*a* and 100*b* over the ground plane 106 so that conductor lines 100*a* and 100*b* each slightly overlaps with the ground plane 106. Addition of lumped-element capacitive loadings at terminals A5 and B5 can also be made using surface-mount capacitors and via holes to the ground plane. A varactor diode in addition to or in place of the lumped-element capacitors or overlap capacitance may also be added to allow tuning of the antenna for real-time optimization of performance.

Figure 11:
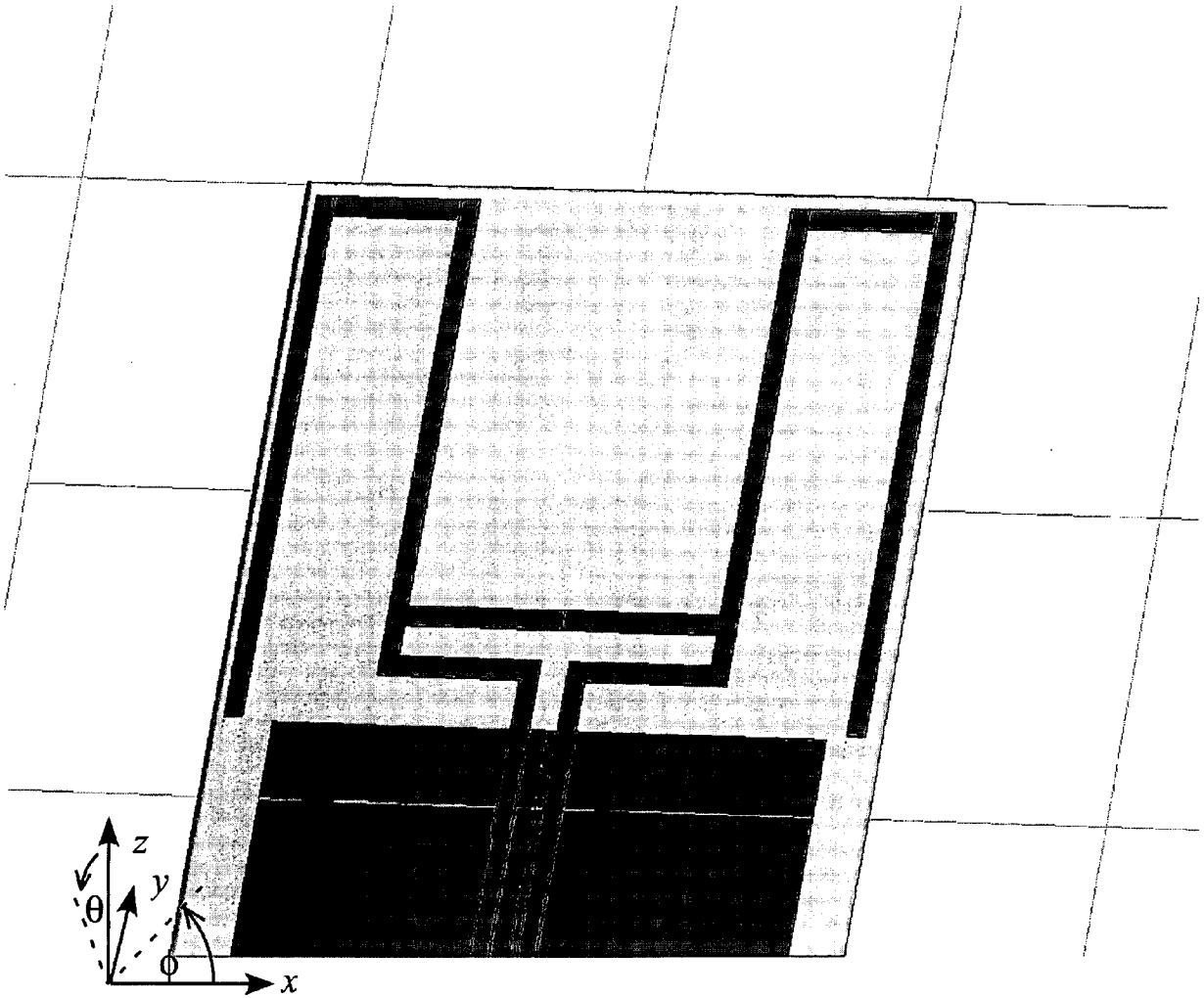
FIG. 11 is a diagram illustrating geometrical definitions of an exemplary antenna used simulations.
Figure 12:
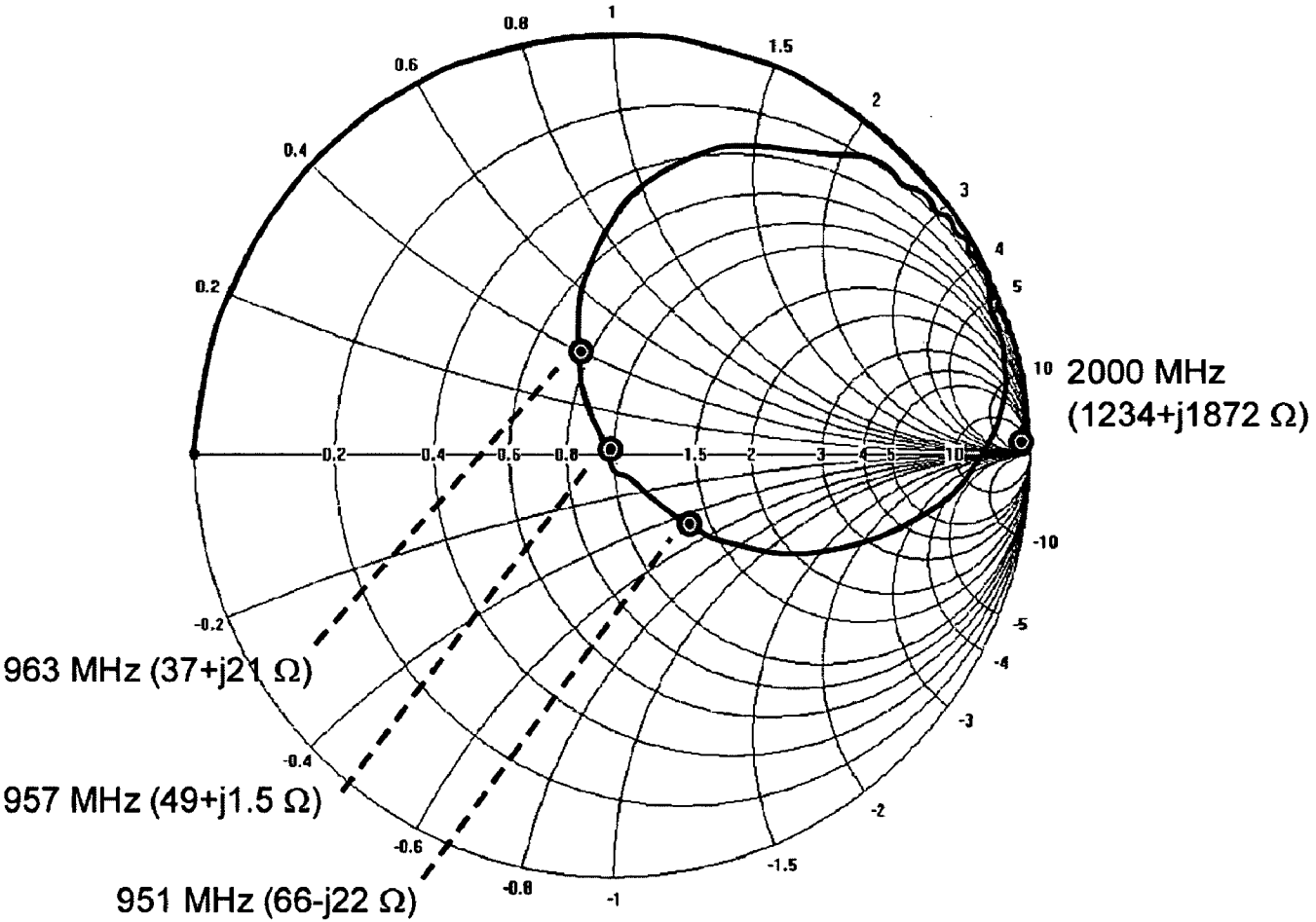
FIG. 12 is a smith chart of simulated impedance response of the exemplary antenna.
Figure 13:
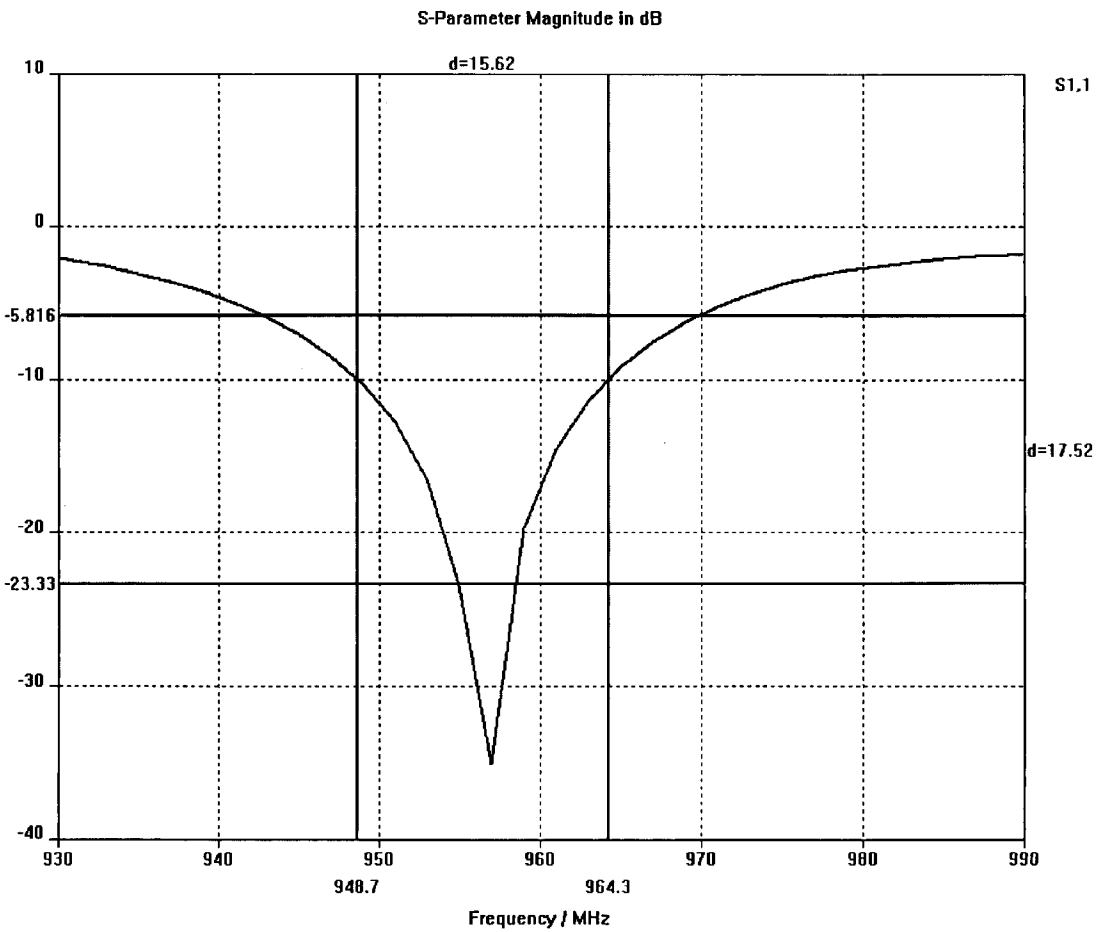
FIG. 13 is a chart of simulated input return loss vs. frequency for the exemplary antenna

Simulations are performed to examine the performance of antenna 100 using geometries shown in FIG. 11 and Table 1. FIG. 12 illustrates simulated impedance response of antenna 100 drawn in a Smith chart, and FIG. 13 illustrates simulated return loss vs. frequency for antenna 100. Generally speaking, the input impedance Zin of antenna 100 can be expressed as Zin=Re(Zin)+j*Im(Zin), where Re(Zin) is the real impedance and Im(Zin) is the imaginary part of the impedance. Resonance occurs when, Im(Zin) is zero or near zero. As shown in FIG. 12, according to the simulations, antenna 100 exhibits an impedance of (37+j21) Ohm at 963 MHz frequency, an impedance of (49+j1.5) Ohm at 957 MHz frequency, and an impedance of (66−j22) Ohm at 951 MHz frequency. As shown in FIG. 13, the simulated return loss for antenna 100 has a dip indicating a resonant frequency at about 957 MHz.

TABLE 1

| Parameter | Value | Units |
|---|---|---|
| Substrate | FR4 | |
| Substrate thickness | 710 | μm |
| L | 31 | mm |
| H | 11 | mm |
| L1 | 9 | mm |
| L2 | 34 | mm |
| g | 2 | mm |
| d | 2 | mm |
| s | 3 | mm |
| w | 1.3 | mm |

For simplicity, a plastic radome, which is used to enclose the circuit board supporting the antenna, as discussed in more detail below, was omitted during simulation. The inclusion of the radome would shift the resonant frequency toward the center of the ISM band, i.e., the nominal 915 MHz. The depth of the resonance dip is associated with the real impedance of antenna 100 at resonance and is about 35 dB. A 10 dB impedance bandwidth of antenna 100 is about 15.62 MHz.

Figure 14:
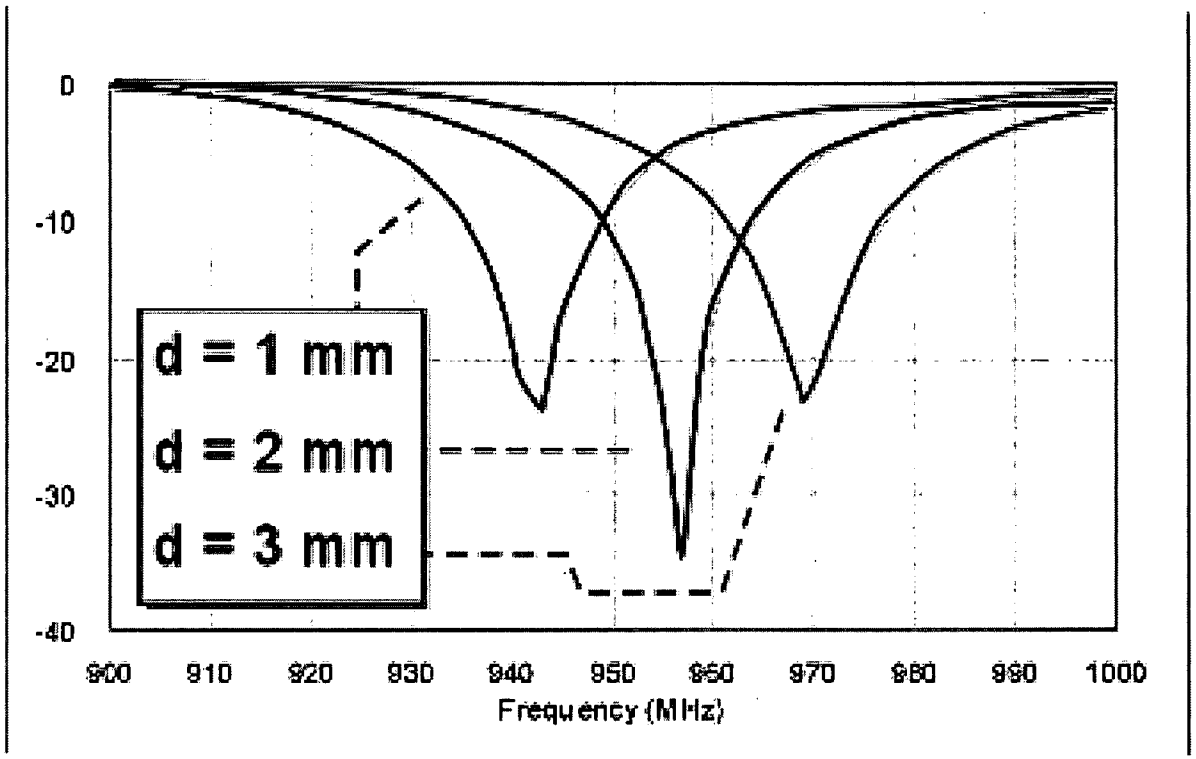
FIG. 14 is a chart of simulated input return loss of antennas having various values for the shunt inductor spacing d.
Figure 15:
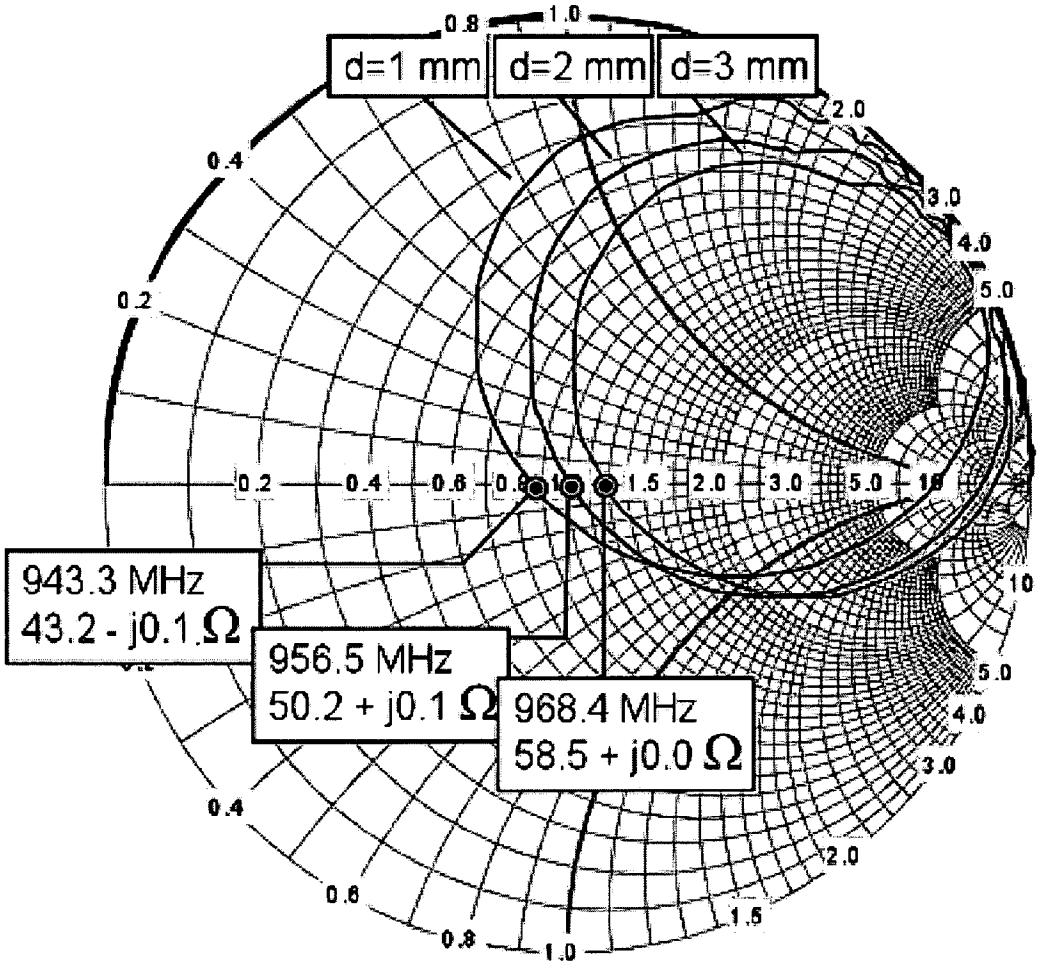
FIG. 15 includes Smith charts of simulated impedance responses for various values of shunt inductor spacing d.

The depth and location of the dip can be adjusted by adjusting the geometry of antenna 100. Simulations show that the gap d between the tuning stub 102 and the feed 101 influences the resonant frequency and the return loss at resonance. FIG. 14 illustrates results of simulations done to show the effect of the gap d between the tuning stub 102 and the feed 101 on the resonant frequency and the return loss at resonance. FIG. 15 shows the corresponding Smith charts of the simulated impedance response of antenna 100 when d is varied.

Figure 16:
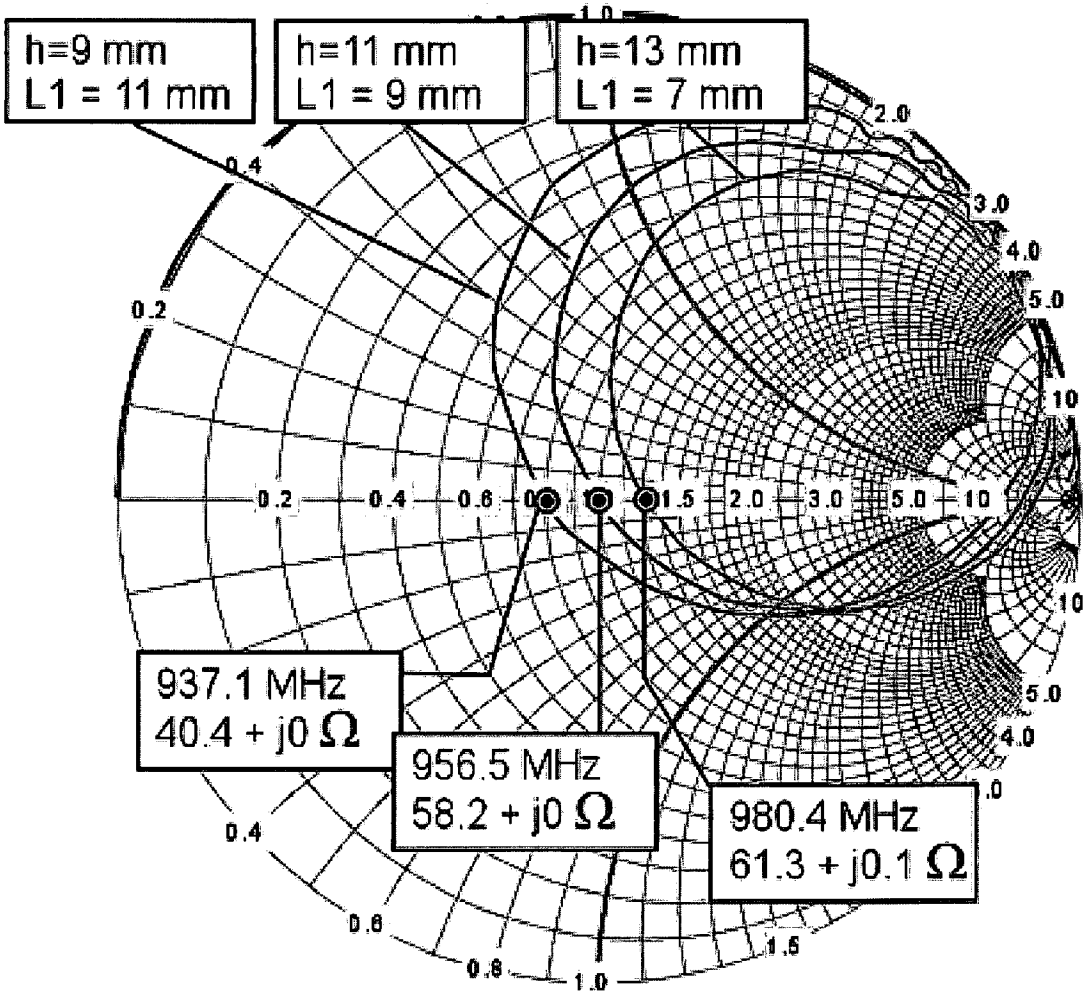
FIG. 16 includes Smith charts of simulated impedance responses for various values of width parameters H and L1.

FIG. 16 shows Smith charts of the simulated impedance response of antenna 100 for different sets of H and L1 values. Adjustments in the width parameters H and L1 influence the radiation resistance of the antenna. These two parameters may be adjusted while maintaining the sum roughly constant to adjust the real impedance at resonance. As shown in FIG. 16, the resonant frequency increases when H increases and L1 decreases.

Adjusting the length of the downward legs L2 mainly affects the resonant frequency without changing the radiation resistance much; thus L2 may be used to adjust the center frequency after the other parameters have been adapted for the desired bandwidth and return loss.

Figure 17:
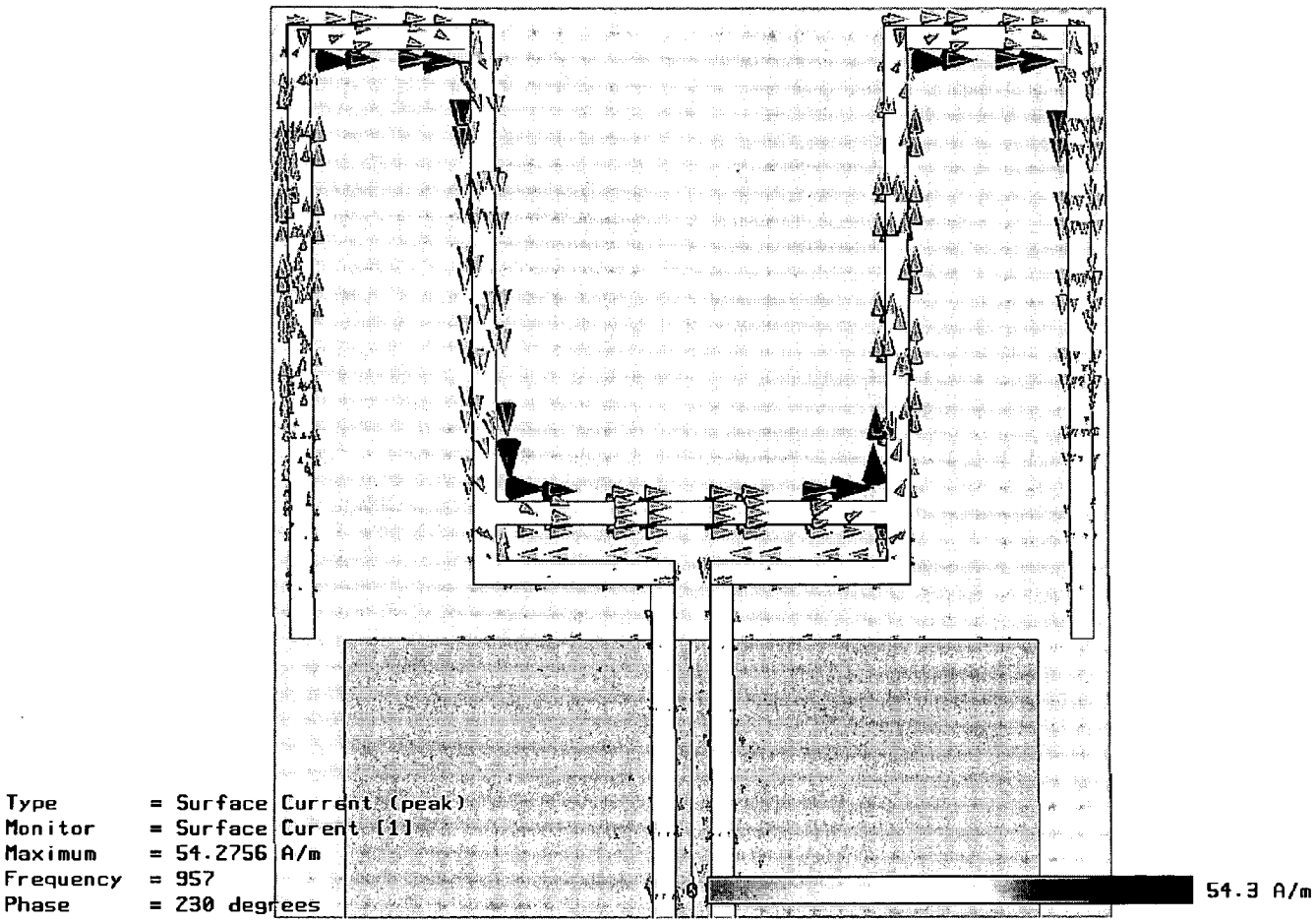
FIG. 17 is a diagram illustrating simulated direction and magnitude of surface currents in the exemplary antenna.
Figure 18:
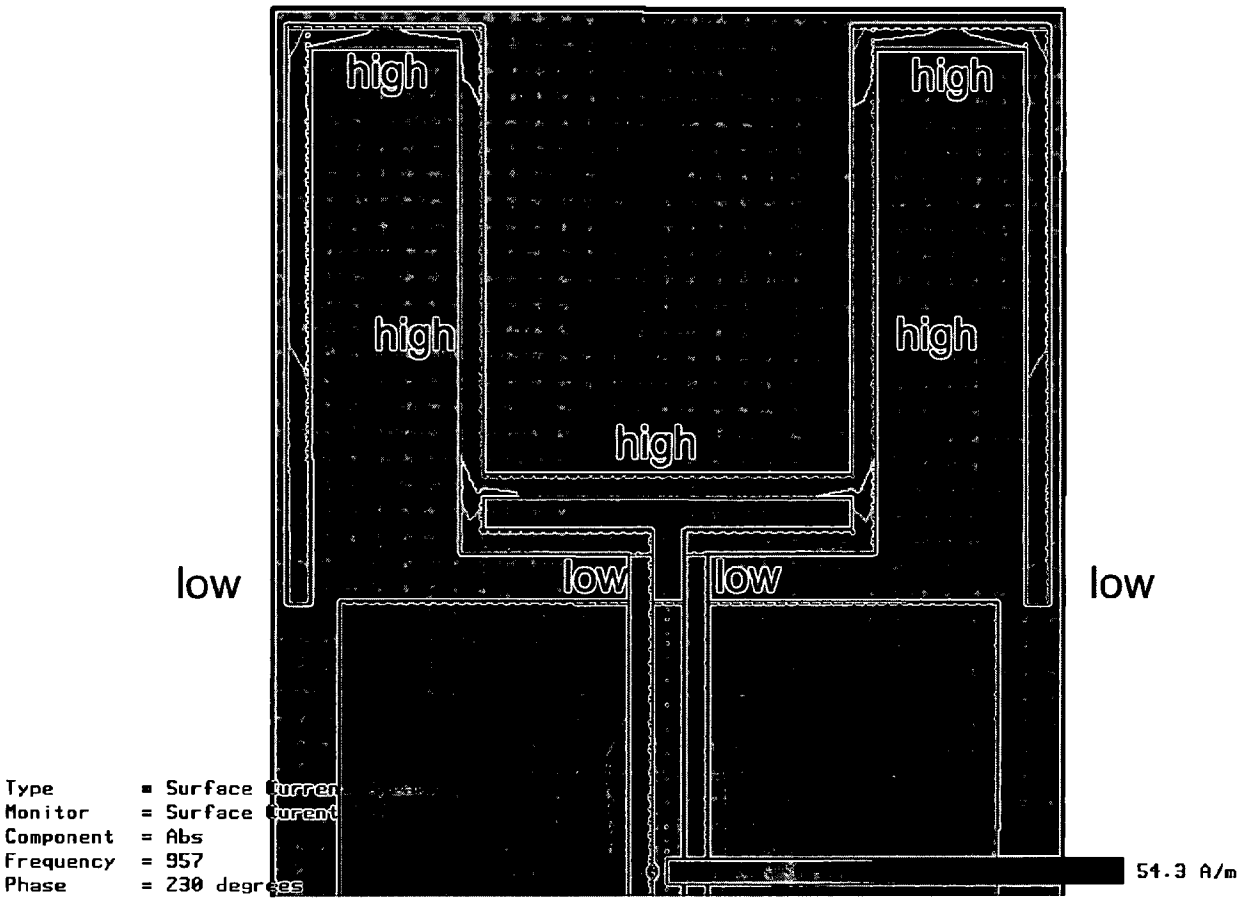
FIG. 18 is a diagram showing simulated distribution of the magnitude surface current in the exemplary antenna.

FIG. 17 illustrates simulated current distribution in antenna 100 where the current is shown as arrows whose directions indicate the directions of the current flow in various parts of antenna 100 and whose sizes are roughly proportional to the magnitude of the current. FIG. 18 is a contour chart of the magnitude of the current density in antenna 100. In the example shown in FIGS. 15–18, the maximum current density is about 54.3 A/m of linewidth. It is apparent that the current density is maximized in the inductive shunt or stub 102, the vertical risers 103, and the cross members 104. The current density in the feed lines 101 is relatively low. The simulation agrees with the theory that the inductive stub 102 and the second parts of conductor lines 100*a* and 100*b* above the inductive stub 102 form a resonant circuit with a reasonably high quality factor Q, so that large reactive currents flow. The feed lines 101 see nearly real impedance and supply smaller real current, which is oppositely directed relative to the current in the stub 102. The current density is high on the horizontal cross members 104, promoting radiation along the y-axis. The current density on the left and right vertical risers 103 is oppositely directed and cancels in the far field, contributing to minimal radiation in directions perpendicular to the y-axis.

Figure 19:
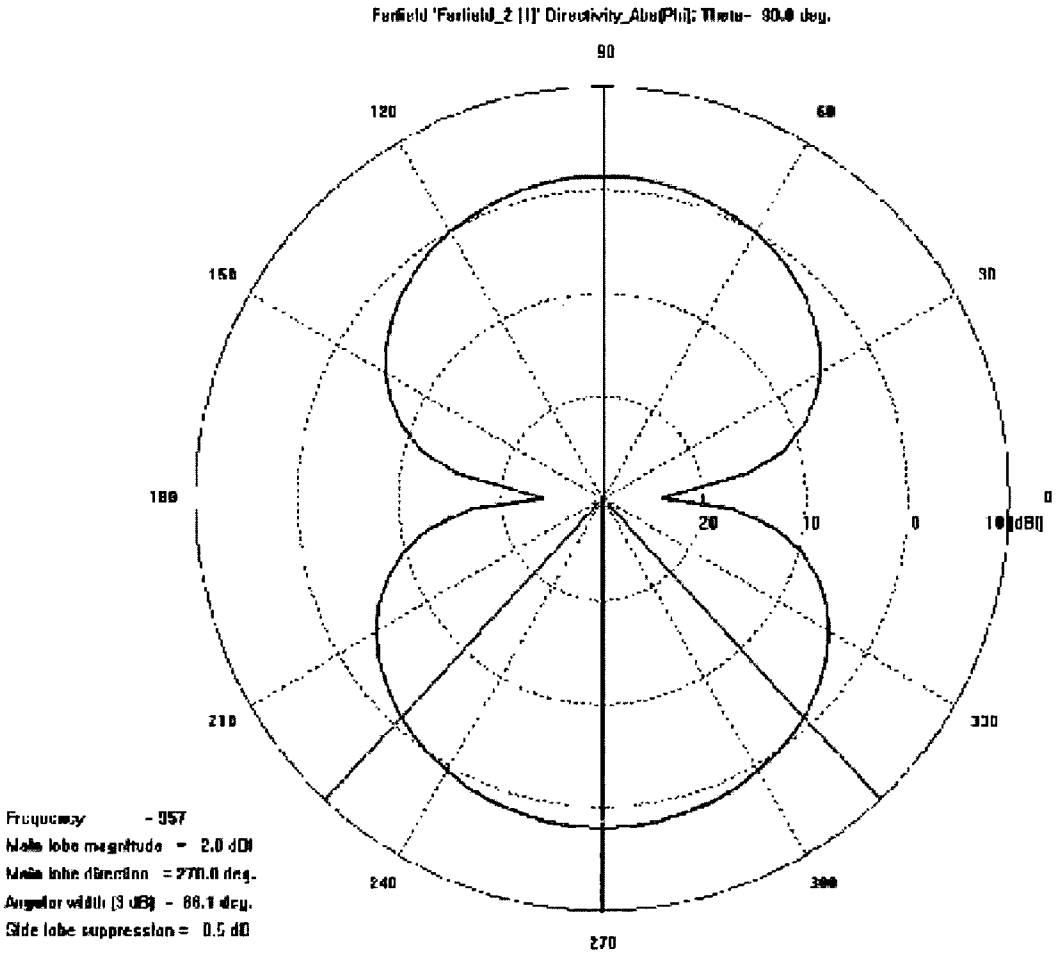
FIG. 19 is a diagram illustrating simulated radiation pattern on an x-y plane.
Figure 20:
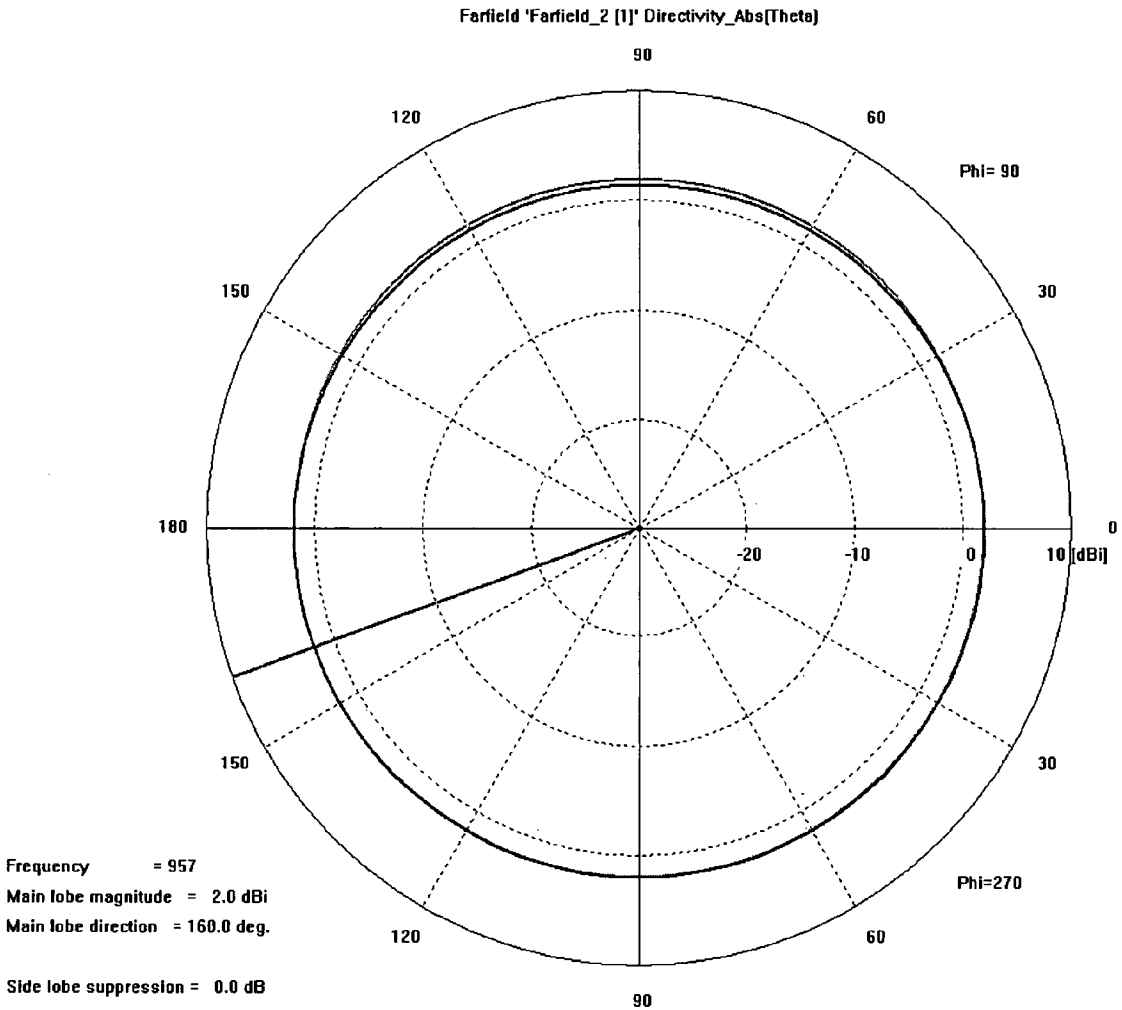
FIG. 20 is a diagram illustrating simulated radiation pattern on a y-z plane.

FIGS. 19 and 20 illustrate simulated radiation pattern of antenna 100. As shown in the figures, the radiation from antenna 100 is omni-directional in the y-z plane and the radiation towards the front (+y) and back (−y) of antenna 100 is about equal according to the simulations. In practice the backward radiation in the −y direction would be of reduced significance both because of the presence of the device into which the reader card containing the antenna is inserted and the likely presence of a user of the reader card. In certain applications the backward radiation could represent a disadvantage, as at high output powers, there may be some concern for the safety of the user. Further work is required to establish whether the backward radiation from antenna 100 represents a problem.

Simulations are also performed to investigate the effect of changes in the linewidth w of conductor lines 100*a*, 100*b*, and 102. According to the simulations, changes in the linewidth w only weakly affect the behavior of the antenna; for example, a 30% change in linewidth induces roughly a 20% change in the impedance of the antenna at resonance. The risers 103 may be tilted as much as 10 degrees from the vertical towards the CL axis of the antenna with little effect on the impedance or gain of the antenna.

EXAMPLE 1

Figure 21:
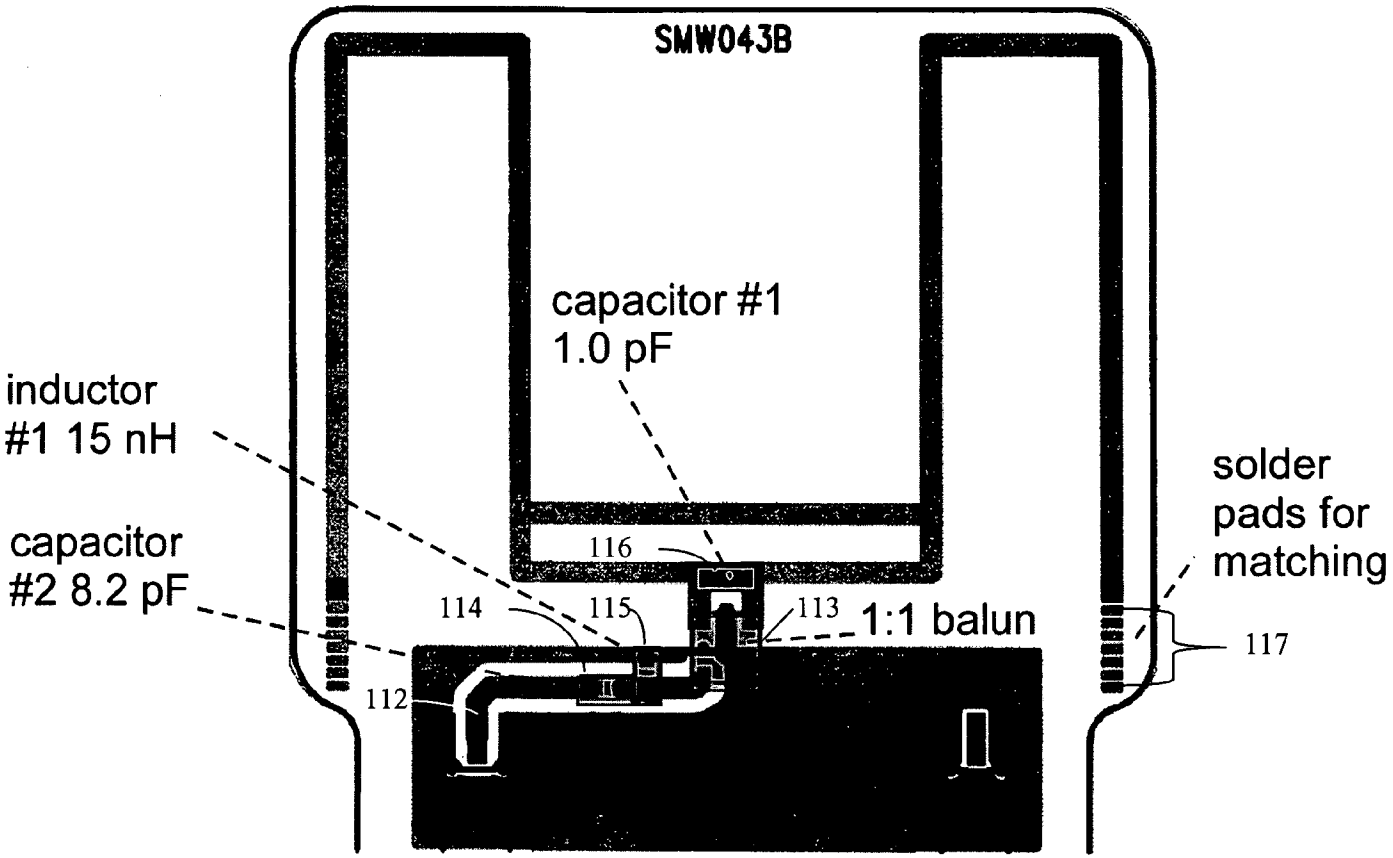
FIG. 21 is a diagram illustrating an exemplary circuit board layout of the exemplary antenna including discrete matching elements realized as surface-mount components.

FIG. 21 illustrates a circuit board layout of antenna 100 according to one embodiment of the present invention. Antenna 100 in FIG. 11 is constructed on a printed circuit board 120 using parameters given in Table 1. These parameters are chosen to provide good matching and radiation in the US industrial, scientific, and medical (ISM) band having a frequency range from 902 MHz to 928 MHz. FIG. 21 also shows an input line 112 for receiving a single-ended radio signal and a conventional wire-wound balun 113 employing a ferrite core and bifilar winding, which is employed to provide a transition between the single-ended input line 112 and antenna 100. Discrete matching components including a capacitor 114 inserted in input line 112, an inductor 115 coupled between input line 112 and ground plane 106, and a capacitor 116 coupled between terminals A and B of conductor lines 100*a* and 100*b* of antenna 100 are also provided to compensate for effects caused by imperfection of balun 113.

Figure 22:
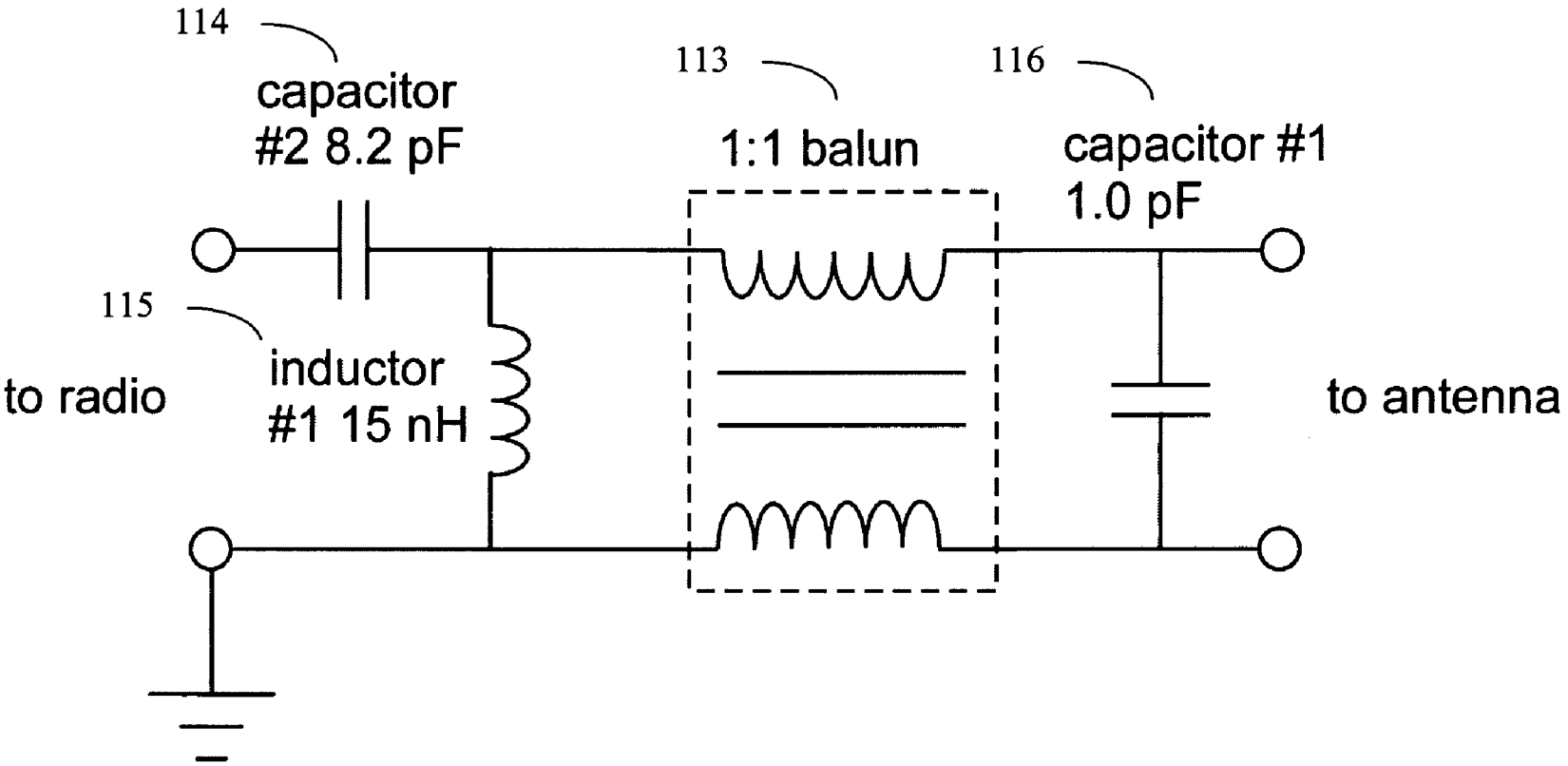
FIG. 22 is a circuit schematic of the discrete matching elements.

Capacitor 114, inductor 115, and capacitor 116 are also employed to compensate for small changes in frequency that may result when a plastic radome is incorporated to protect antenna 110, as discussed in more detail below. A schematic diagram of the matching elements is shown in FIG. 22. To provide some external tuning capability, a varactor diode can be used in place of or in series with capacitor 114, or coupled between line 112 and ground plane 106 as appropriate to provide a shunt capacitance.

Referring back to FIG. 21, since length L2 of the downward legs 105 primarily affects the resonant frequency with little change in the impedance of the antenna, antenna 110 may further include solder pads 117 placed in rows extending from terminals A5 and B5 in the negatively direction. Solder pads 117 are provided to allow for convenient increases in length L2 by wire bonding or soldering and thus provide a second method of easily adjusting the resonant frequency to compensate for small changes resulting from the radome, manufacturing tolerances, effects of the remainder of the board and the portable device into which the board is installed, and other minor influences.

Figure 23A:
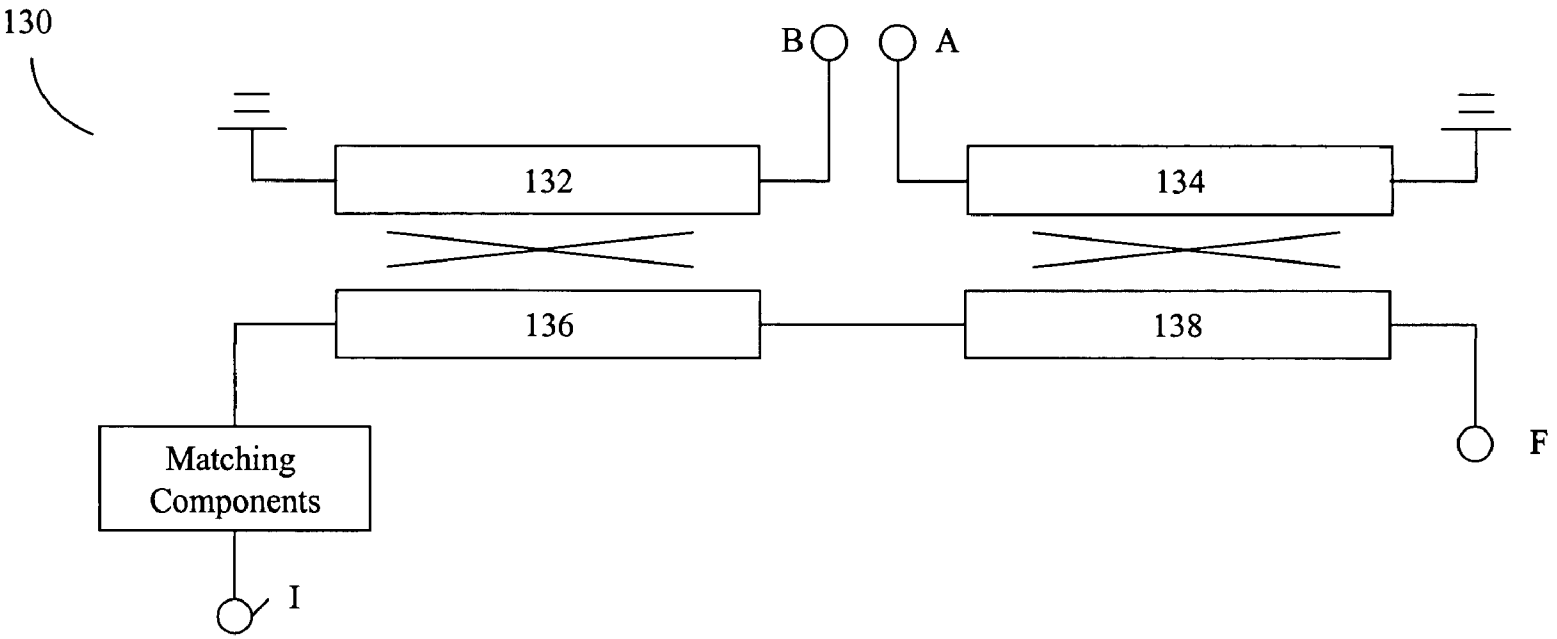
FIGS. 23A–23C are diagrams illustrating a planar Marchand balun that can be used to convert between a single-ended radio signal input and the balanced inputs to the antenna.

Instead of the wire-wound balun 113, a planar Marchand balun can be used to transition between a single-ended signal input I to the balanced inputs A and B of antenna 100. As shown in FIG. 23A, the planar Marchand balun 130 comprises a first pair of transmission lines 132 and 134 and a second pair of transmission lines 136 and 138, each transmission line being approximately a quarter wavelength in length. Transmission line 132 is connected between input B of antenna 100 and ground, transmission line 134 is connected between input A of antenna 100 and ground, and transmission lines 136 and 138 are serially connected with each other between the single-ended input I and a floating terminal F. Transmission line 136 is connected to the single-ended input I through a plurality of discrete matching components such as those shown in FIG. 22. Furthermore, transmission lines 136 and 138 are arranged to be close to transmission lines 132 and 134 to allow coupling of the signal fed to transmission lines 136 and 138 into transmission lines 132 and 134. See also R. Schwindt, C. Nguyen, "Computer-Aided Analysis and Design of a Planar Multilayer Marchand Balun", IEEE Trans. on Microwave Theory and Techniques, July 1994, vol. 42, issue 7, pp 1429–1434, which is incorporated herein by reference.

Figures 23B, 23C:
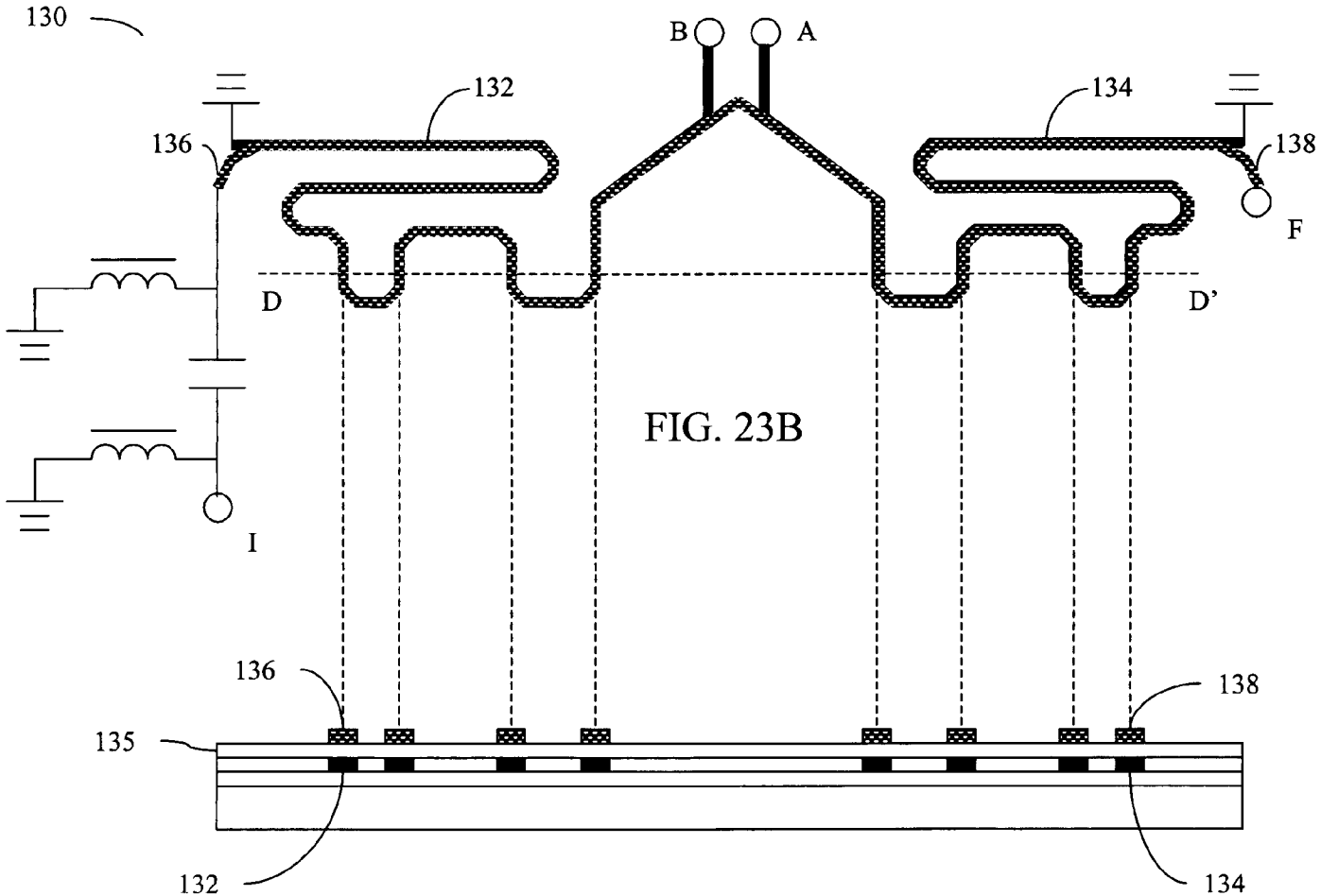

FIG. 23B illustrates one arrangement of transmission lines 132, 134, 136, and 138 on a printed circuit board 120 according to one embodiment of the present invention. FIG. 23C illustrates a cross sectional view of the printed circuit board 120 across line D–D'. As shown in FIGS. 23B and 23C, the first pair of transmission lines 132 and 134 and the second pair of transmission lines 136 and 138 are etched metal lines formed on different layers of the printed circuit board 120, with the second pair of transmission lines 136 and 138 being directly over the first pair of transmission lines 132 and 134 and separated from the first pair of transmission lines 132 and 134 by a layer of dielectric material 135. This allows efficient coupling of the input signal from the second pair of transmission lines 136 and 138 into the first pair of transmission lines 132 and 134. The circuitous routes taken by transmission lines 132, 134 136, and 138 in FIG. 23B are just one way to fit the quarter-wavelength long transmission lines into the space allowed on the printed circuit board 120. The transmission lines can be shaped differently.

Figure 24A:
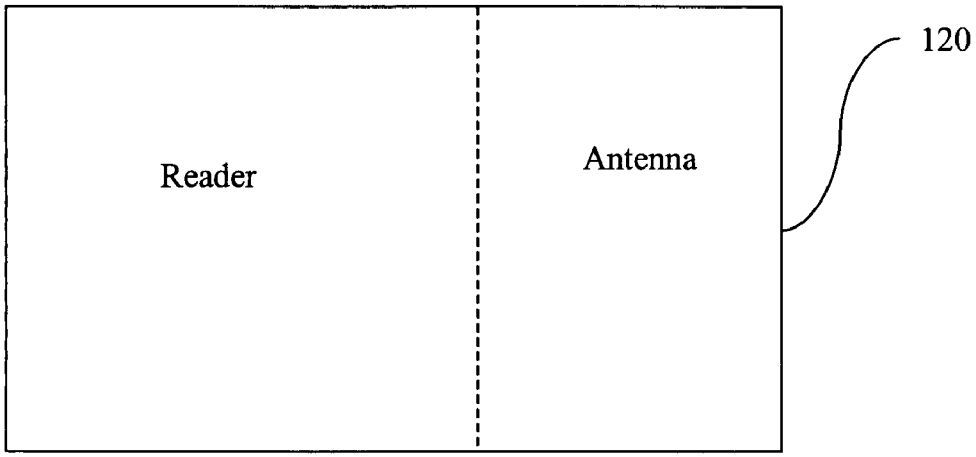
FIGS. 24A–24D are top and cross sectional views of a printed circuit board accommodating a reader and the exemplary antenna.
Figure 24B:
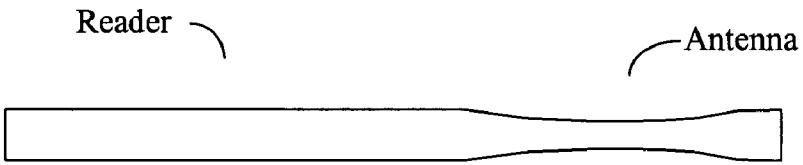

In one embodiment of the present invention, as shown in FIG. 24A, antenna 100 is built on the same printed circuit board 120 as the RFID reader employing the antenna for transmitting the interrogation signals and for receiving the responding signals from RFID tags. While antenna 100 only requires one layer of etched metal lines as conductor lines 100*a*, 100*b*, and 102, the RFID reader often uses multiple internal layers of etched metal lines for interconnecting various components of the RFID reader. Thus, when layers of printed circuit board 120 are pressed together, the part of the printed circuit board 120 for accommodating the reader can be significantly thicker than the part of the printed circuit board 120 for accommodating the antenna, as shown in FIG. 24B. This may cause bubbles to form in the part of the printed circuit board accommodating the antenna, thus affecting the robustness of the antenna.

Figure 24C:
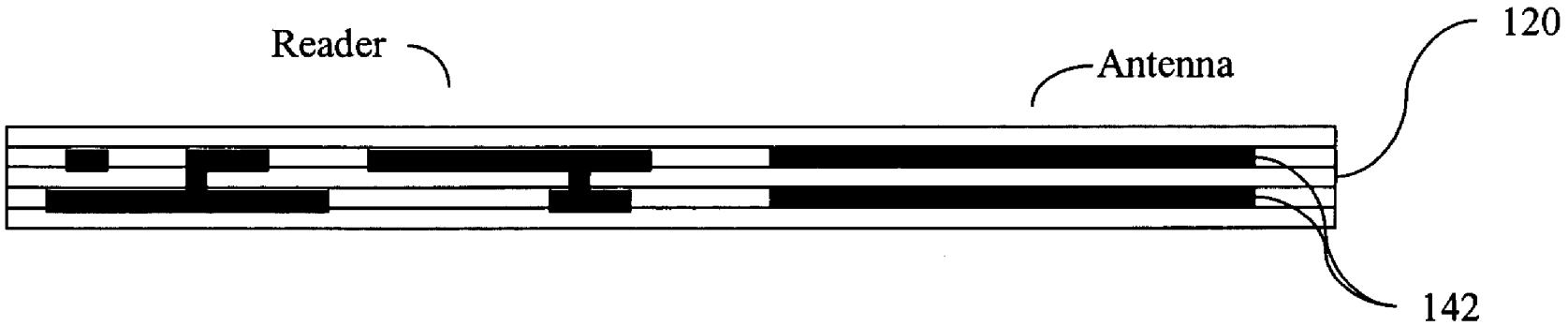
Figure 24D:
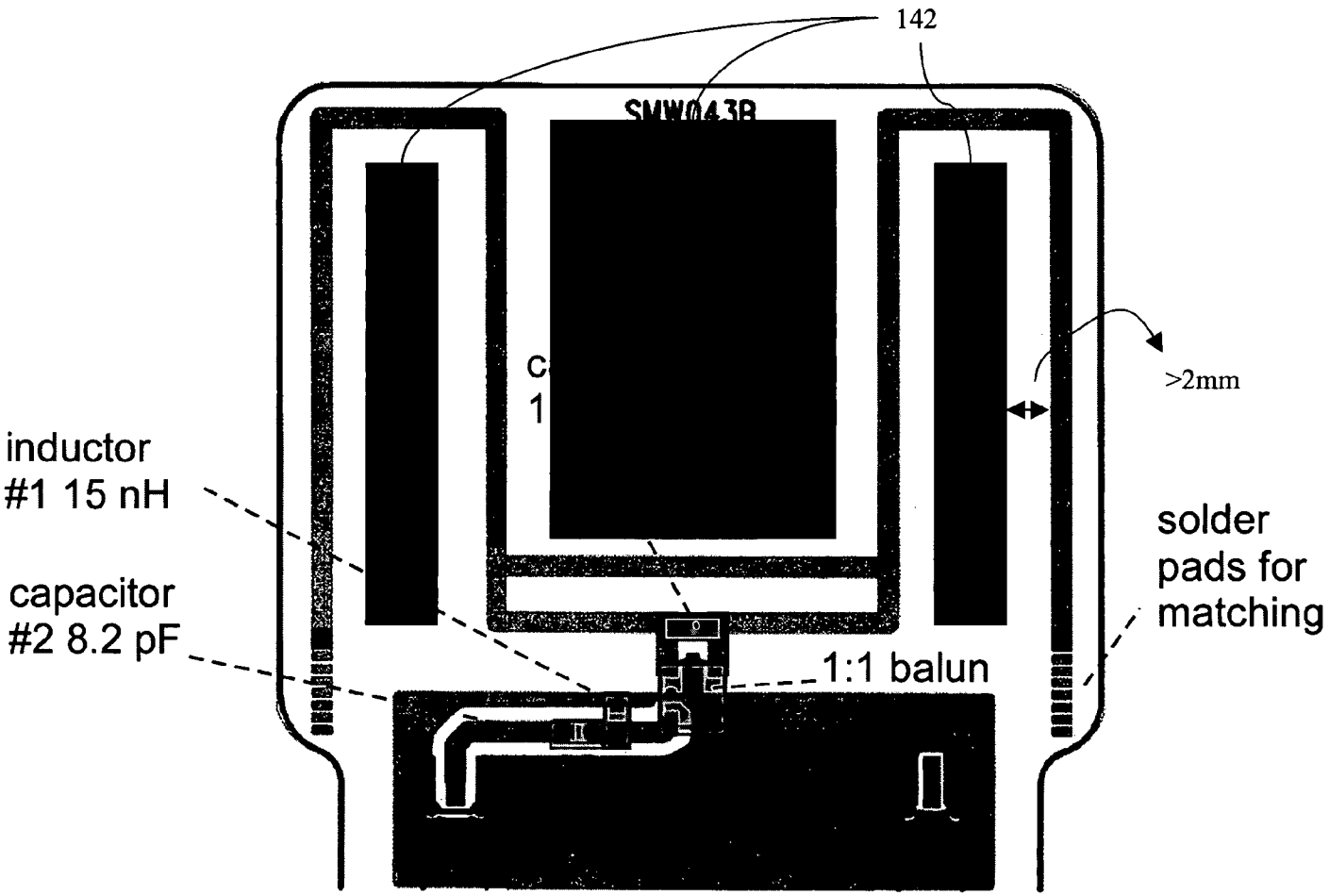

To solve the problem, interlayer metal planes 142 can be placed in the part of the printed circuit board accommodating the antenna, as shown in FIG. 24C. FIG. 24D illustrates a top-down view of the printed circuit board 120. As shown in FIG. 24D, interlayer metal planes 142 are placed in the spaces surrounded by the riser 103, cross member 104 and downward leg 105 of each of conductor lines 100*a* and 100*b*, and in the space between conductor lines 100*a* and 100*b*, while keeping a minimum distance of about 2 mm from conductor lines 100*a* and 100*b*. Interlayer metal planes 142 help to bring even thickness of the printed circuit board 120 and to make the part of the printed circuit board 120 supporting antenna 100 more robust without drastically affecting the performance of antenna 100.

Figure 25:
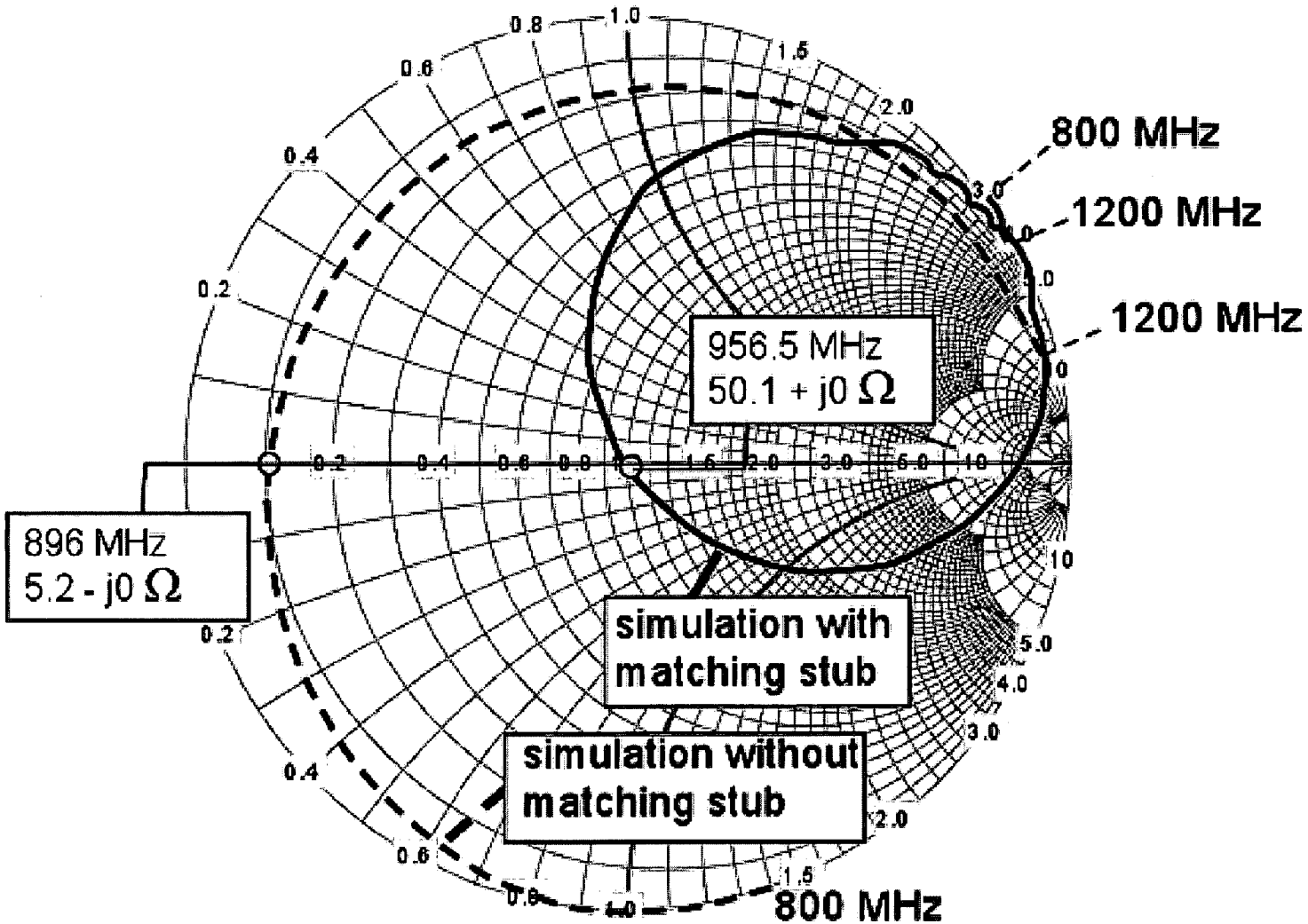
FIG. 25 includes Smith charts of simulated impedance response of the exemplary antenna with and without the inductive matching stub 102.
Figure 26:
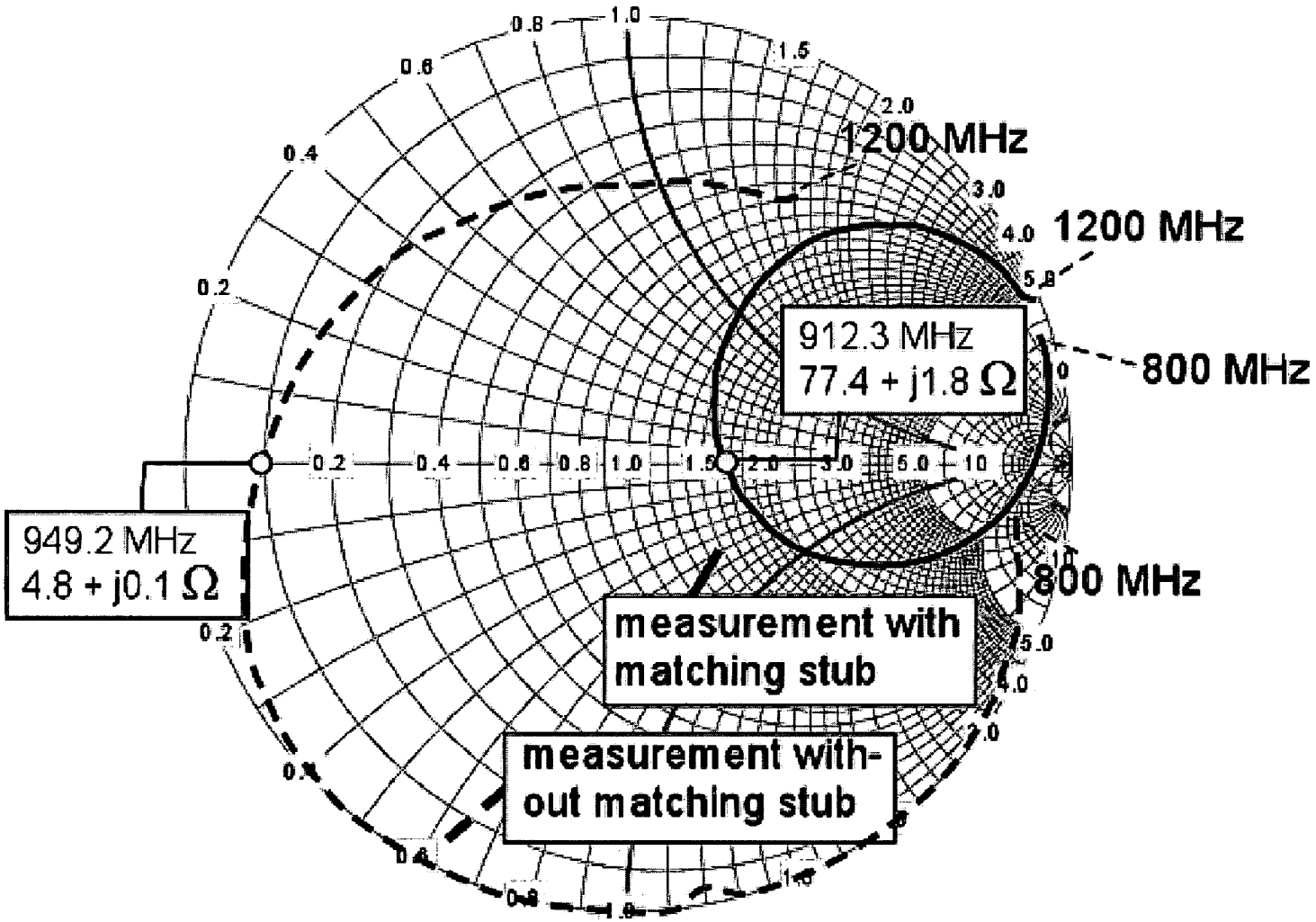
FIG. 26 includes Smith charts of measured impedance response of the exemplary antenna with and without the inductive matching stub 102.

FIGS. 25 and 26 illustrate simulated and measured effects, respectively, of the inductive shunt or matching stub 102 on the impedance response of antenna 100. The simulated impedance response with and without the matching stub 102 is shown in FIG. 25. The measured impedance response with and without the matching stub 102 is shown in FIG. 26. Good qualitative agreement is obtained between the simulation and measurements, although there is some quantitative disagreement in the estimate of resonant frequencies. This discrepancy is probably due to the difficulties of accurately removing the effect of the balun from the measured data to obtain the impedance of the antenna structure. As shown in FIGS. 25 and 26, the matching stub 102 acts to transform the relatively low equivalent radiation resistance (in the neighborhood of 5 ohms) of the rest of antenna 100 to a much higher value of around 50 ohms, making it easy to match the antenna to a 50-ohm transmission line used to connect the antenna to the radio.

Figure 27:
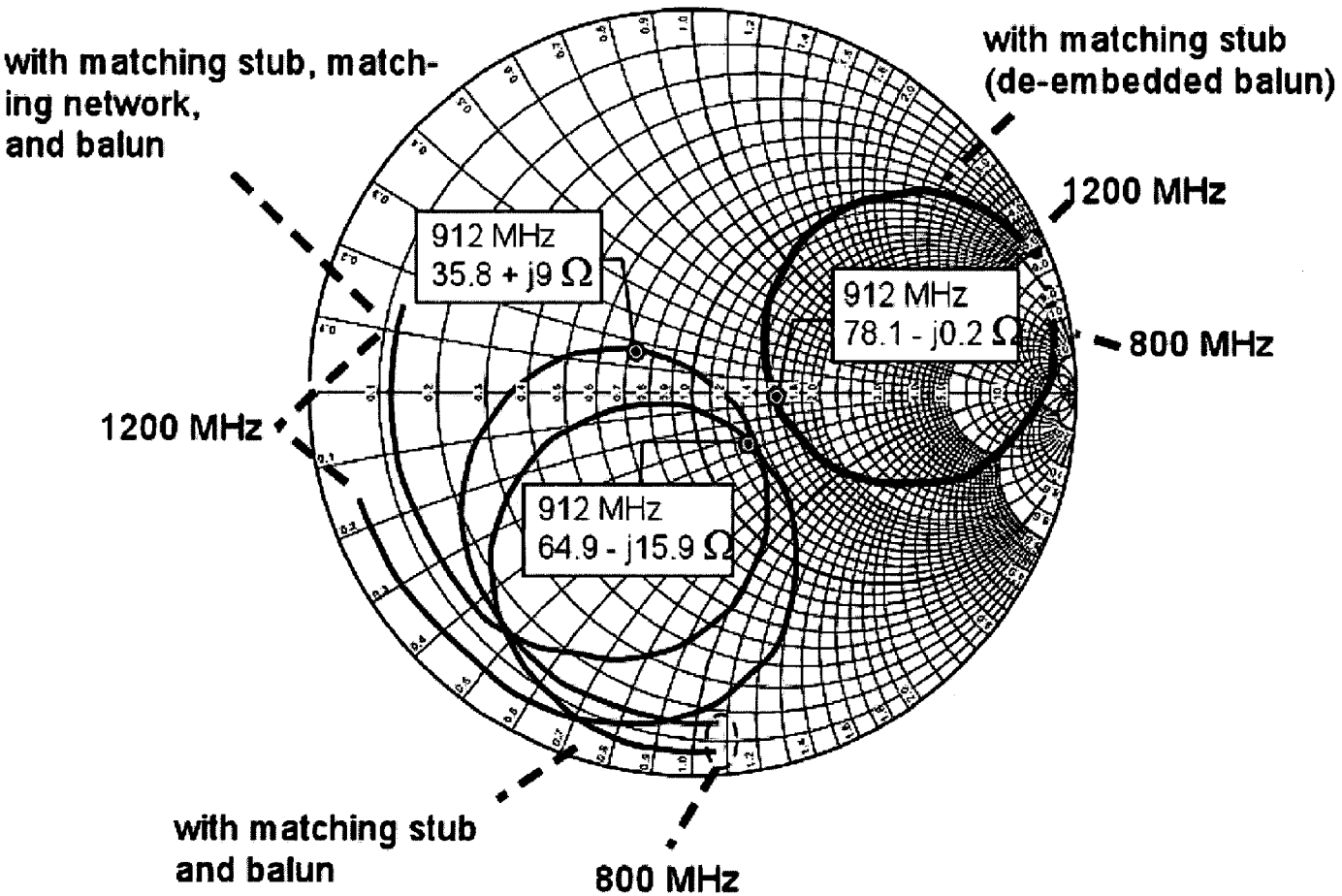
FIG. 27 includes Smith charts of measured impedance response of the exemplary antenna with and without the discrete matching elements.

FIG. 27 illustrates measured impedance responses of antenna 100 showing the effect of the matching network formed by the discrete matching components 114, 115, and 116 and the balun 113.

EXAMPLE 2

Figure 28:
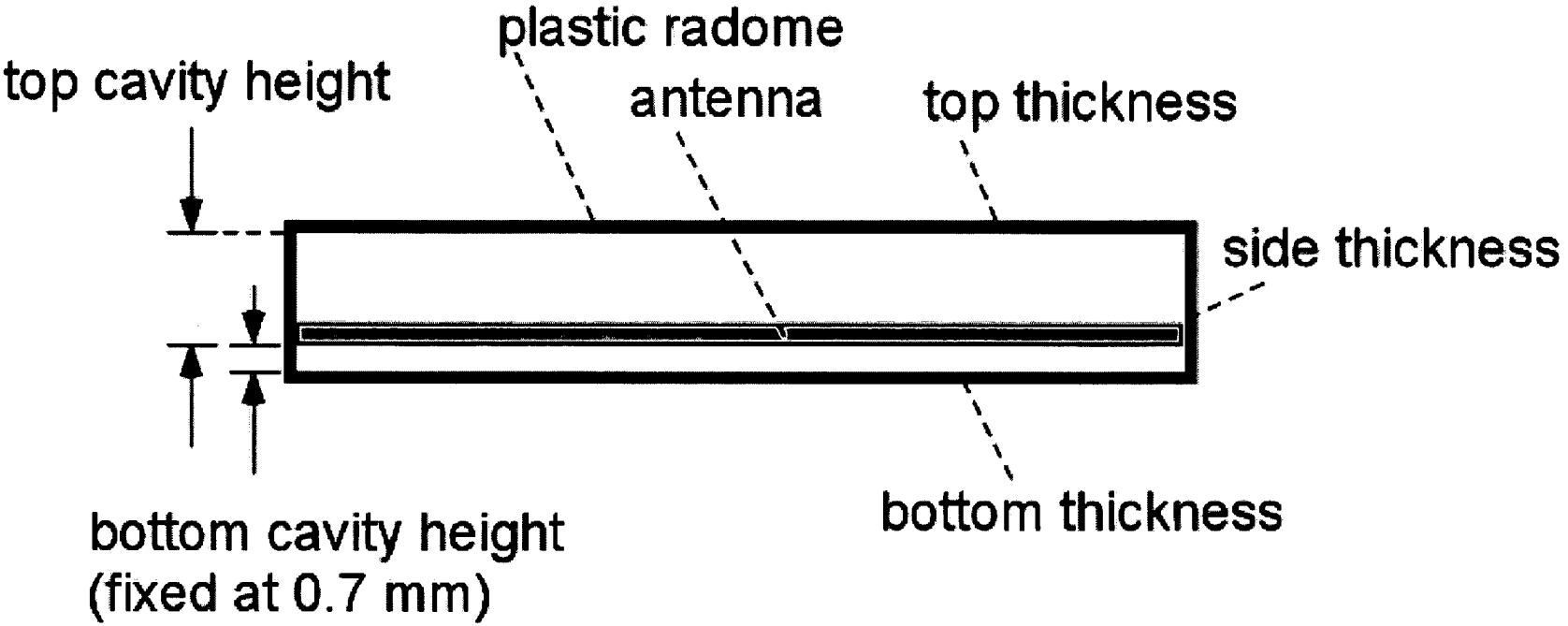
FIG. 28 is a diagram illustrating configuration of a radome for enclosing the exemplary antenna.

A test antenna was constructed to examine the effects of the dimensions and placement of a plastic enclosure ('radome'). The dimensions of this antenna are shown in Table 2. FIG. 28 explains the nomenclature describing the radome configuration.

TABLE 2

| Parameter | Value | Units |
|---|---|---|
| Substrate | FR4 | (NA) |
| Substrate thickness | 710 | microns |
| L | 31 | mm |
| H | 11 | mm |
| L1 | 9 | mm |
| L2 | 32 | mm |
| g | 3.6 | mm |
| d | 2 | mm |
| s | 3.5 | mm |
| w | 1.3 | mm |
| Bottom Cavity Height | 0.7 | mm |
| Radome dielectric constant | 3 | (NA) |

The effects of the radome is examined by simulations using a variety of differing radome configurations. The simulation results for different cases of antenna radome configuration are summarized in Table 3.

TABLE 3

| Cases | Top Cavity Height [mm] | Bottom Thickness [mm] | Top Thickness [mm] | Side Thickness [mm] | Resonant Frequency [MHz] Im(Zin = 0 Ω) | Re(Zin) at Resonant Frequency [Ω] |
|---|---|---|---|---|---|---|
| 1 | 6.6 | 1.30 | 1.30 | 1.30 | 948 | 60 |
| 2 | 6.6 | 0.65 | 0.65 | 0.65 | 974 | 67 |
| 3 | 6.6 | 1.30 | 0.65 | 0.65 | 961 | 61 |
| 4 | 6.6 | 0.65 | 1.30 | 1.30 | 962 | 65 |
| 5 | 6.6 | 0.65 | 0.65 | 1.30 | 965 | 66 |
| 6 | 2.3 | 1.30 | 1.30 | 1.30 | 943 | 55 |

TABLE 3-continued

| Cases | Top Cavity Height [mm] | Bottom Thickness [mm] | Top Thickness [mm] | Side Thickness [mm] | Resonant Frequency [MHz] Im(Zin = 0 Ω) | Re(Zin) at Resonant Frequency [Ω] |
|---|---|---|---|---|---|---|
| 7 | 2.3 | 0.65 | 0.65 | 0.65 | 972 | 63 |
| 8 | | No Radome | | | 1011 | 76 |

A regression fit to the simulations for the resonant frequency is given in Table 4, and a regression fit to the simulations for the real input impedance in Table 5. In each case the factors have been normalized so that their values vary from −1 to +1 and that the effects of each variable can be directly compared. The case with no radome is included as having zero wall thickness and median cavity height. Here the standard error is the estimated error in the coefficient value, and the t-ratio is the ratio of the coefficient to the error estimate. Ratios between −1 and 1 indicate that the coefficient in question is not significant; and ratios greater than 3 or smaller than −3 provide good confidence that the coefficient value is meaningful.

TABLE 4

Resonant frequency

| Normalized variable | Coefficient | standard error | t-ratio |
|---|---|---|---|
| Constant | 960 | 1.43 | 673 |
| Top cavity height | 1.64 | 1.46 | 1.1 |
| Bottom thickness | −8.26 | 1.30 | −6.4 |
| Top thickness | −1.44 | 2.24 | −0.6 |
| Side thickness | −6.32 | 1.92 | −3.3 |

$R^2$=98.9% $R^2$(adjusted)=97.3% s=3.4 with 8−5=3 degrees of freedom

It is clear that the largest effects of the radome geometry on the resonant frequency result from changes in the bottom and sidewall thicknesses. The real part of the input impedance is mostly affected by the bottom thickness of the radome, with a more modest effect from the top cavity height.

TABLE 5

Real part of input imdedance at resonance

| Normalized variable | Coefficient | standard error | t-ratio |
|---|---|---|---|
| Constant | 61.3 | 0.52 | 117 |
| Top cavity height | 2.04 | 0.54 | 3.8 |
| Bottom thickness | −3.28 | 0.48 | −6.9 |
| Top thickness | −0.31 | 0.82 | −0.4 |
| Side thickness | −0.97 | 0.70 | −1.4 |

$R^2$=98.3% $R^2$(adjusted)=95.9% s=1.2 with 8−5=3 degrees of freedom

While the invention has been described with respect to a specific implementation at a specific frequency, it will be appreciated that the inventive principles can be applied by persons of ordinary skill to a wide variety of related applications in which compact, broadside-radiating antennas with good tolerance of ambient variation need to be employed.

I claim:

1. A balanced compact antenna, comprising:

first and second signal inputs;

a first conductor line comprising a first portion extending from the first signal input in a first direction, a second portion extending from an end of the first portion a length L in a second direction, a third portion extending from an end of the second portion a length L1 in a third direction, and a fourth portion extending from an end of the third portion a length L2 in a fourth direction, the third direction being substantially parallel to the first direction, the second direction being substantially perpendicular to the first direction, and the fourth direction being substantially opposite to the second direction;

a second conductor line comprising a fifth portion extending from the second signal input in a fifth direction, a sixth portion extending from an end of the fifth portion a length L in a sixth direction, a seventh portion extending from an end of the sixth portion a length L1 in a seventh direction, and an eighth portion extending from an end of the seventh portion a length L2 in a eighth direction, the fifth direction being substantially opposite to the first direction, the seventh direction being substantially parallel to the fifth direction, the sixth direction being substantially perpendicular to the fifth direction, and the eighth direction being substantially opposite to the sixth direction; and a third conductor line extending a length H from a center of the third conductor line toward both a first midpoint in the first conductor line and a second midpoint in the second conductor line, the third conductor line being separated from the first or second signal input by a distance d.

2. The antenna of claim 1 with a resonant length equal to a length measured from the center of the third conductor line along a center line running through the third conductor line and the first or second conductor line to the end of the first or the second conductor line, which length is about a quarter of a wavelength corresponding to a center frequency of a frequency band in which the antenna is to operate.

3. The antenna of claim 1 wherein the first, second and third conductor lines each has a width w and H+L+L1+L2−d−w is about a quarter of a wavelength corresponding to a center frequency of a frequency band in which the antenna is to operate.

4. The antenna of claim 1 wherein the first and second conductor lines are configured as mirror images of each other with respect to a center line axis and wherein the third conductor line acts as a shunt inductance to a virtual ground potential along the center line axis between the first and second conductor lines.

5. The antenna of claim 1 further comprising a pair of coplanar transmission lines connected to respective ones of the first and second inputs.

6. The antenna of claim 1 further comprising a balun coupled between a single-ended signal input and the first and second inputs.

7. The antenna of claim 6 further comprising discrete matching components coupled between the balun and the single-ended signal input.

8. The antenna of claim 6 wherein the balun is a wire-wound balun.

9. The antenna of claim 6 wherein the balun is a planar Marchand balun comprising a first transmission line connected between the first input and ground, a second transmission line connected between the second input and ground, and third and fourth transmission lines serially connected with each other between the single ended signal input and a floating terminal, each transmission line being about a quarter wavelength in length.

10. The antenna of claim 9 wherein the first and second transmission lines are formed on a first layer of a printed circuit board and the third and fourth transmission lines are formed on a second layer of the printed circuit board.

11. The antenna of claim 1 built on a printed circuit board and further comprising a plurality of solder pads near ends of the first and second conductor lines.

12. The antenna of claim 1 built on a printed circuit board and further comprising at least one ground plane on a side of the printed circuit board, an edge of the ground plane being near ends of the first and second conductor lines.

13. The antenna of claim 1 built on a same multi-layered printed circuit board on which is also built an RFID reader, the antenna further comprising interlayer metal planes between the first, second and third conductor lines.

14. A compact antenna for transmitting RF signals, comprising:

first and second signal inputs;

first and second conductor lines extending from respective ones of the first and second signal inputs, each conductor line comprising a riser and a radiating cross member; and a third conductor line extending between the risers of the first and second conductor lines; and wherein when a RF signal is supplied to the first and second signal inputs, radiation from currents in the radiating cross members add substantially in-phase to radiation from currents in the third conductor line while radiation from currents in the riser in the first conductor line substantially cancels radiation from currents in the riser in the second conductor line.

15. The antenna of claim 14 wherein the third conductor line is separated from the first or second signal input by a distance d.

16. The antenna of claim 15 having a resonant frequency dependent upon the distance d.

17. The antenna of claim 15 wherein the third conductor line has a length 2H, each riser has a length L and width w, each radiating cross member has a length L1, the first and second conductor lines each further comprises a downward leg having a length L2, and the antenna has a resonant length of H+L+L1+L2−d−w.

18. The antenna of claim 17 having a return loss dependent upon H and L1 and substantially independent upon L2.

19. The antenna of claim 17 having a resonant frequency dependent upon d and L2.

20. The antenna of claim 17 having a maximum current density in the third conductor line.

* * * * *